US008475692B2

(12) United States Patent
Sumida et al.

(10) Patent No.: US 8,475,692 B2
(45) Date of Patent: Jul. 2, 2013

(54) NANOFIBER MANUFACTURING APPARATUS AND NANOFIBER MANUFACTURING METHOD

(75) Inventors: Hiroto Sumida, Nara (JP); Takahiro Kurokawa, Osaka (JP); Kazunori Ishikawa, Osaka (JP); Yoshiaki Tominaga, Kanagawa (JP); Mikio Takezawa, Tokyo (JP); Mitsuhiro Takahashi, Ehime (JP); Masahide Yokoyama, Osaka (JP)

(73) Assignee: Panasonic Corporation, Osaka (JP)

( * ) Notice: Subject to any disclaimer, the term of this patent is extended or adjusted under 35 U.S.C. 154(b) by 435 days.

(21) Appl. No.: 12/935,297

(22) PCT Filed: Mar. 23, 2009

(86) PCT No.: PCT/JP2009/001256

§ 371 (c)(1),
(2), (4) Date: Sep. 29, 2010

(87) PCT Pub. No.: WO2009/122669

PCT Pub. Date: Oct. 8, 2009

(65) Prior Publication Data

US 2011/0059261 A1 Mar. 10, 2011

(30) Foreign Application Priority Data

Apr. 2, 2008 (JP) ..... 2008-096539
May 7, 2008 (JP) ..... 2008-121717
Jul. 8, 2008 (JP) ..... 2008-178233

(51) Int. Cl.
*D04H 1/72* (2006.01)

(52) U.S. Cl.
USPC ..... 264/6; 264/8; 264/10; 264/465; 425/6; 425/8; 425/174.8 E

(58) Field of Classification Search
None
See application file for complete search history.

(56) References Cited

U.S. PATENT DOCUMENTS

| | | | |
|---|---|---|---|
| 2002/0122840 | A1 | 9/2002 | Lee et al. |
| 2006/0024399 | A1 | 2/2006 | Chang et al. |
| 2006/0290031 | A1 | 12/2006 | Jirsak et al. |
| 2010/0072674 | A1 | 3/2010 | Takahashi et al. |
| 2010/0148405 | A1 | 6/2010 | Sumida et al. |

FOREIGN PATENT DOCUMENTS

| | | |
|---|---|---|
| JP | 2-273566 | 11/1990 |
| JP | 2002-201559 | 7/2002 |
| JP | 2004-238749 | 8/2004 |
| JP | 2005-213668 | 8/2005 |

(Continued)

OTHER PUBLICATIONS

Full English translation (machine) of JP 2005-213668, Aug. 2005.

(Continued)

*Primary Examiner* — Mary F Theisen
(74) *Attorney, Agent, or Firm* — Wenderoth, Lind & Ponack, L.L.P.

(57) ABSTRACT

Nanofibers are manufactured while preventing explosions from occurring due to solvent evaporation. An effusing unit (201) which effuses solution (300) into a space, a first charging unit (202) which electrically charges the solution (300) by applying an electric charge to the solution (300), a guiding unit (206) which forms an air channel for guiding the manufactured nanofibers (301), a gas flow generating unit (203) which generates, inside the guiding unit (206), gas flow for transporting the nanofibers, a diffusing unit (240) which diffusing the nanofibers (301) guided by the guiding unit (206), a collecting apparatus which electrically attracts and collects the nanofibers (301), and a drawing unit (102) which draws the gas flow together with the evaporated component evaporated from the solution (300) are included.

4 Claims, 13 Drawing Sheets

FOREIGN PATENT DOCUMENTS

| | | |
|---|---|---|
| JP | 2006-037329 | 2/2006 |
| JP | 2007-505224 | 3/2007 |
| JP | 2008-150769 | 7/2008 |
| JP | 2009-228168 | 10/2009 |
| WO | 2008/142845 | 11/2008 |

OTHER PUBLICATIONS

International Search Report issued Jun. 30, 2009 in International (PCT) Application No. PCT/JP2009/001256.

NANOFIBER MANUFACTURING APPARATUS AND NANOFIBER MANUFACTURING METHOD

TECHNICAL FIELD

The present invention relates to a nanofiber manufacturing apparatus which manufactures nanofibers by using an electrostatic stretching phenomenon (an electrospinning method).

BACKGROUND ART

Electrospinning is known as a method for manufacturing filamentous (fibrous form) substances (nanofibers) made of resin or the like and having a diameter in a submicron scale.

In the electrospinning method, nanofibers are manufactured by effusing (ejecting) a solution which is a raw material liquid into a space through a nozzle or the like, while charging the solution by applying an electric charge so as to cause the solution traveling the space to undergo the electrostatic stretching phenomenon. Here, the solution is prepared by dispersing or dissolving resin or the like in a solvent.

More specifically, the volume of the electrically charged and effused solution decreases as the solvent evaporates from the solution traveling the space. On the other hand, the electric charge applied to the solution remains in the solution. As a result, charge density of the particles of the solution traveling the space increases. Since the solvent in the solution continuously evaporates, the charge density of the solution further increases. When Coulomb force, which is generated in the solution and acts oppositely, exceeds the surface tension of the solution, the solution undergoes a phenomenon in which the solution is explosively stretched into filament (electrostatic stretching phenomenon). Such electrostatic stretching phenomenon repeatedly occurs at an exponential rate in the space, thereby manufacturing nanofibers made of resin with a submicron diameter (for example, see Patent Reference 3).

The solvent for the solution used in such a method needs to be easily volatilized. Liquids having such properties are typically organic solvents in light of availability, cost and the like. However, most organic solvents are flammable. Therefore, taking measures to prevent the evaporated solvent from exploding is an important concern.

In view of such concerns, there is a proposed method for preventing explosions by closing the space where the solvent evaporates and filling the space with inert gas such as nitrogen so as to remove, from the space, oxygen that causes explosions (for example, see Patent Reference 1).

Further, a thin film having three dimensional structure of three dimensional mesh can be obtained by depositing nanofibers thus manufactured on a deposition member or the like. Further, by depositing the nanofibers thicker, a highly porous web having submicron mesh can be manufactured. Thus manufactured thin film and highly porous web can be preferably applied to a filter, a separator for use in a battery, a resin electrolyte membrane or an electrode for use in a fuel cell, or the like. Such applications of the highly porous web made of the nanofibers are expected to significantly improve performances of those devices.

Conventionally, when manufacturing such web made of the nanofibers, as disclosed in Patent Reference 2, an elongated highly porous web is manufactured by depositing nanofibers on an elongated band shaped deposition member which is wound around a winding member, and collecting the deposition member along with the nanofibers deposited thereon. When there is no more deposition member to be supplied, it is replaced with a new deposition member, and a highly porous web made of nanofibers is manufactured.

The nanofibers manufactured in the space are deposited and used as a nonwoven fabric in some cases. In this case, uniform thickness of the nonwoven fabric and uniform diameter of the nanofibers making up the nonwoven fabric are required. Thus, the inventors of the present application have previously proposed a nanofiber manufacturing apparatus which can provide spatially even distribution of nanofibers by transporting the nanofibers by gas flow, and diffusing the nanofibers together with the gas flow. By depositing the spatially and evenly distributed nanofibers, a nonwoven fabric having two-dimensionally uniform quality can be manufactured.

Patent Reference 1: Japanese Unexamined Patent Application Publication No. 2-273566

Patent Reference 2: Japanese Unexamined Patent Application Publication No. 2006-37329

Patent Reference 3: Japanese Unexamined Patent Application Publication No. 2004-238749

DISCLOSURE OF INVENTION

Problems that Invention is to Solve

However, when the solvent evaporates in a sealed space, density of the solvent in the space increases. This impedes the solvent from evaporating from the solution. In the case of paint and the like disclosed in Patent Reference 1, evaporation of the solvent may not be a significant issue, but in the case of manufacturing nanofibers, slow evaporation of the solvent prevents the electrostatic stretching phenomenon from easily occurring. This results in problems where the diameter of the manufactured nanofibers is large or the necessary amount of nanofibers is not generated.

The present invention has been conceived in view of the problems, and has a first object to provide a nanofiber manufacturing apparatus and a nanofiber manufacturing method which allows manufacture of the nanofibers in a state where explosions are prevented without impeding evaporation of the solvent from the solution.

Further, in a single nanofiber manufacturing apparatus, in the case where it is necessary to change the kinds of nanofibers to be manufactured to manufacture a different kind of web, a new deposition member needs to be provided to the nanofiber manufacturing apparatus after all of an elongated deposition member is wound around a winding member. This causes a problem where changeover is time-consuming.

Further, different methods may be used for depositing nanofibers depending on the kinds of nanofibers. This results in requiring more time and effort for the changeover.

The present invention has been conceived in view of the above problems, and has a second object to provide a nanofiber manufacturing apparatus which can reduce time required for the changeover.

Further, the inventors of the present application have encountered in their studies a problem of unevenness of nonwoven fabric manufactured by the conventional nanofiber manufacturing apparatus. For example, in the case where the manufacturing condition of the nanofibers is changed, problems may occur such as inability of ensuring desired evenness; and thus, it is sometimes difficult to ensure stable manufacturing quality of the manufacturing apparatus.

In view of such problems, as a result of devoted studies and experiments, the inventors have found that manufacturing quality can be improved by making the shape of the portion which diffuses nanofibers into the space a predetermined shape.

The present invention has been conceived based on such finding, and has a third object to provide a nanofiber manufacturing apparatus which can ensure spatial evenness of nanofibers being manufactured and achieve a stable evenness.

Means to Solve the Problems

In order to achieve the objects, the nanofiber manufacturing apparatus according to an aspect of the present invention includes: an effusing unit which effuses a solution which is a raw material liquid for nanofibers into a space; a first charging unit which electrically charges the solution by applying an electric charge to the solution; a guiding unit which forms an air channel for guiding the nanofibers that are manufactured; a gas flow generating unit which generates, inside the guiding unit, gas flow for transporting the nanofibers; a collecting apparatus which collects the nanofibers; and an attracting apparatus which attracts the nanofibers to the collecting apparatus.

With this, in the nanofiber manufacturing apparatus, the solution evaporates in the gas flow, and the electrostatic stretching phenomenon occurs. As a result, volatile solvents do not stay in the space. Accordingly, it is possible to manufacture nanofibers while maintaining the concentration level of the solvent which does not exceed the explosion limit inside the guiding unit. Thus, it is possible to achieve high explosion-proof performance.

Further, it is preferable that a second charging unit is included which electrically charges the nanofibers transported by the gas flow to a same polarity as a charge polarity of the nanofibers.

With this, it is possible to easily attract the nanofibers using the collecting electrode by charging again the nanofibers which become electrically less charged or neutralized after being transported.

Further, it may be that a compressing unit is included for compressing the space where nanofibers transported by gas flow are present so that density of the nanofibers in the space is increased.

With this, it is possible to increase evenness of spatial distribution of nanofibers by increasing the space density of the nanofibers by the compressing unit and then diffusing the nanofibers rapidly by the diffusing unit.

It is preferable that the solution contains polymer resin constituting the nanofibers in the range of not less than 1 vol % and not more than 50 vol %, and contains organic solvent that is evaporable solvent in the range of not less than 50 vol % and not more than 99 vol %.

With this, even if the solution includes the solvent of 50 vol % or more as above, the solvent evaporates sufficiently, which allows electrostatic stretching phenomenon to occur. Since the nanofibers are manufactured from the state where the resin that is solute is thin, thinner nanofibers can be manufactured. Further, the adjustable range of the solution can be increased, allowing wider range of performances of the nanofibers to be manufactured.

Further, it is preferable that the collecting apparatus includes: a deposition member which is in an elongated band shape and on which the nanofibers are deposited; a supplying unit which supplies the deposition member; a transporting unit which collects the deposition member; and a body which is movable with the deposition member, the supplying unit, and the transporting unit mounted on the body.

With this, the deposition member can be replaced easily by moving the body from the nanofiber manufacturing apparatus. This improves manufacturing efficiency of the nanofiber manufacturing apparatus.

Further, it is preferable that the nanofiber manufacturing apparatus includes a plurality of collecting apparatuses including the collecting apparatus, in which a first collecting apparatus, which is one of the collecting apparatuses, is mounted with an electric field attracting apparatus which attracts the nanofibers using an electric field, the deposition member included in a second collecting apparatus, which is another one of the collecting apparatuses, includes an air hole for ensuring air permeability, and the second collecting apparatus is further mounted with a gas attracting apparatus which attracts the nanofibers using the gas flow With this, in the case where changeover is being performed in one collecting apparatus separated from the nanofiber manufacturing apparatus, another collecting apparatus can be mounted to the nanofiber manufacturing apparatus for manufacturing the nanofibers. Thus, time required for the changeover can be reduced, and the attracting apparatus can be easily changed depending on the kinds of the nanofibers and the deposition states.

Further, the nanofiber manufacturing apparatus may further include a diffusing unit which is an air channel for diffusing and guiding the nanofibers with the gas flow, the diffusing unit having a shape in which an opening area having a cross section perpendicular to a transporting direction of the nanofibers continuously increases in the transporting direction of the nanofibers.

With this, uniform spatial distribution of the nanofibers is possible. Further, stable operation is possible while maintaining the uniform spatial distribution of the nanofibers.

Further, in order to the above objects, the nanofiber manufacturing method according to an aspect of the present invention includes: effusing a solution which is a raw material liquid for nanofibers into a space; electrically charging the solution by applying an electric charge to the solution; generating gas flow and transporting the nanofibers by the generated gas flow; collecting the nanofibers; and attracting the nanofibers to a predetermined area.

Further, the nanofiber manufacturing method may include electrically charging the nanofibers transported by the gas flow to a same polarity as a charge polarity of the nanofibers.

Further, The nanofiber manufacturing method may include compressing the space where the nanofibers transported by the gas flow are present so as to increase a density of the nanofibers in the space.

By adopting such methods, the same advantageous effects described above can be obtained.

Effects of the Invention

A first advantageous effect according to embodiments of the present invention is that nanofibers can be efficiently manufactured while maintaining a high level of safety against explosions.

A second advantageous effect according to embodiments of the present invention is that multiple collecting apparatuses allow reduction of time required for the changeover.

A third advantageous effect is that a nonwoven fabric having two-dimensionally even quality can be manufactured by ensuring spatial evenness of the nanofibers being manufactured. Further, stable manufacturing of the nonwoven fabric having two-dimensionally even quality is possible.

NUMERICAL REFERENCES

Figure 1:
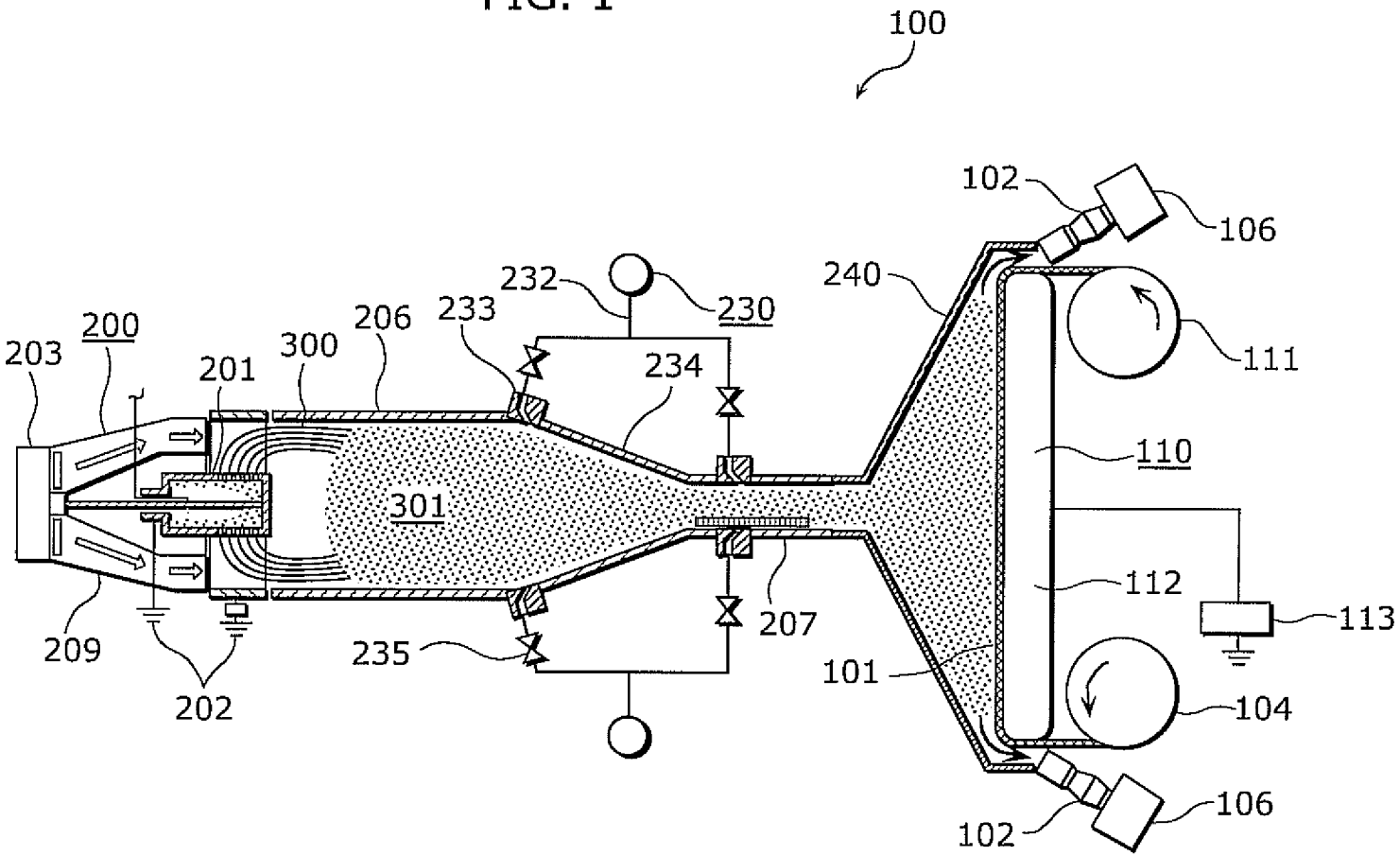
FIG. 1 is a cross-section diagram schematically showing a nanofiber manufacturing apparatus according to one embodiment of the present invention.

100 Nanofiber manufacturing apparatus
101 Deposition member
102 Drawing unit
103 Area regulating unit
104 transporting unit
106 Solvent collecting apparatus
110 Collecting apparatus
111 Supplying unit
112 Attracting electrode
113 Attraction power source
115 Attracting apparatus
117 Body
118 Wheels
200 Discharging apparatus
201 Effusing unit
202 First charging unit
203 Gas flow generating unit
204 Gas flow controlling unit
205 Heating unit
206 Guiding unit
207 Second charging unit
208 Inlet
209 Air channel
211 Effusing body
212 Rotary axis
213 Motor
215 Bearing
216 Effusion holes
217 Supply path
221 Charging electrode
222 Charging power source
223 Grounding unit
230 Compressing unit
232 Second gas flow generating unit
223 Gas flow inlet
234 Compression duct
235 Valve
240 Diffusing unit
300 Solution as raw material liquid
301 Nanofiber

BEST MODE FOR CARRYING OUT THE INVENTION

Embodiment 1

Next, embodiments of a nanofiber manufacturing apparatus according to the present invention are described with reference to the drawings.

FIG. 1 is a cross-section diagram schematically showing a nanofiber manufacturing apparatus according to Embodiment 1 of the present invention.

As shown in FIG. 1, a nanofiber manufacturing apparatus 100 includes: a discharging apparatus 200, a guiding unit 206, a compressing unit 230, a diffusing unit 240, a collecting apparatus 110, a second charging unit 207, and drawing units 102 serving as attracting apparatuses.

The discharging apparatus 200 includes an effusing unit 201, a first charging unit 202, an air channel 209, and a gas flow generating unit 203. The discharging apparatus 200 is a unit which can discharge, by gas flow, charged solution as raw material 300 and nanofibers 301 being manufactured. The discharging apparatus 200 will be later described in detail.

Note that the solution as raw material liquid used for manufacturing the nanofibers is referred to as the solution 300, and the manufactured nanofibers are referred to as the nanofibers 301. However, the solution 300 changes to the nanofibers 301 while undergoing electrostatic stretching phenomenon in the manufacturing of the nanofibers; and thus, the border between the solution 300 and the nanofibers 301 is ambiguous and they cannot be clearly distinguished from each other.

The guiding unit 206 is a duct forming an air channel which guides the manufactured nanofibers 301 to a predetermined area. In the present embodiment, the compressing unit 230 and the diffusing unit 240, which will be described later, are also included in the guiding unit 206 in a sense that they also guide the nanofibers 301.

The compressing unit 230 is an apparatus which has a function of compressing space where the nanofibers 301 transported by the gas flow are present (inside the guiding unit 206) to increase density of the nanofibers 301 in the space. The compressing unit 230 includes a second gas flow generating unit 232 and a compression duct 234.

The compression duct 234 is a tubular member which gradually narrows the space where the nanofibers 301 transported inside the guiding unit 206 are present. The compression duct 234 includes, on its circumferential wall, gas flow inlets 233 which allow the gas flow generated by the second gas flow generating unit 232 to be guided inside the compression duct 234. The connection portion of the compression duct 234 with the guiding unit 206 has an area corresponding to an area of the lead-out end of the guiding unit 206. The lead-out end of the compression duct 234 has an area smaller than the area of the lead-out end of the guiding unit 206. Thus, the compression duct 234 has a funnel shape as a whole, which allows compression of the nanofibers 301 introduced to the compression duct 234 and the gas flow.

Further, the upstream (lead-in) end of the compressing unit 230 has an annular shape which matches the shape of the end of the guiding unit 206. On the other hand, the downstream (ejection side) end of the compressing unit 230 has a rectangle shape. Further, the shape of the downstream (ejection side) end of the compressing unit 230 extends across the entire width direction of a deposition member 101 (vertical direction relative to the drawing sheet of FIG. 1). The length of the downstream end of the compressing unit 230 which corresponds to the traveling direction of the deposition member 101 is shorter than the width direction. The compressing unit 230 has a shape which gradually changes from the upstream end that is in the annular shape toward the downstream end that is in the rectangular shape.

The second gas flow generating unit 232 is an apparatus which generates gas flow by introducing high pressure gas into the compression duct 234. In the present embodiment, the second gas flow generating unit 232 includes a tank (cylinder) which can store high pressure gas, and a gas outlet unit having valves 235 for adjusting pressure of the high pressure gas in the tank.

The second charging unit 207 is an apparatus which is provided to the inner wall of the compressing unit 230, and which has a function of increasing electric charges of the charged nanofibers 301 and charging the electrically neutral nanofibers 301 resulting from neutralization. Examples of the second charging unit 207 includes an apparatus which can discharge, into a space, ions or particles having a same polarity as that of the charged nanofibers 301. More specifically, the second charging unit 207 may utilize any types of methods, such as a corona discharge type, voltage applying type, AC type, stationary DC type, pulsed DC type, self discharge type, soft x-ray type, ultraviolet ray type, and radiation type.

The diffusing unit 240 is a duct which is connected to the compressing unit 230, and which widely diffuses and disperses the nanofibers 301 which have become a high density state by being compressed by the compressing unit 230. The diffusing unit 240 is a hood shaped member which decelerates the nanofibers 301 accelerated by the compressing unit 230. The diffusion unit 240 has a rectangular opening at the upstream end through which the gas flow is introduced, and a rectangular opening at the downstream end through which the gas flow is discharged. The area of the opening at the downstream end is greater than the area of the opening at the upstream end. The diffusing unit 240 has a shape whose area gradually increases from the opening at the upstream end toward the opening at the downstream end. The opening at the downstream end has a width greater than the width of the deposition member 101, and has a length longer than that of an attracting electrode 112 which will be described later.

By the gas flow traveling from the smaller-area lead-in side of the diffusing unit 240 toward the larger-area lead-out side of the diffusing unit 240, the nanofibers 301 which are in a high density state turns into a low density state rapidly and are dispersed. At the same time, the velocity of the gas flow decreases in proportion to the cross-section area of the diffusing unit 240. Therefore, the traveling speed of the nanofibers 301 which are transported by the gas flow also decreases together with the decrease in the velocity of the gas flow. Here, the nanofibers 301 are gradually diffused evenly in accordance with the increase in the cross-section area of the diffusing unit 240. Accordingly, it is possible to evenly deposit the nanofibers 301 on the deposition member 101. Further, a state is made where the nanofibers 301 are not transported by the gas flow, that is, the state where the gas flow and the nanofibers 301 are separated; and thus, the charged nanofibers 301 are attracted to the attracting electrode 112 which has an opposite polarity, without being influenced by the gas flow.

The collecting apparatus 110 is an apparatus which collects the nanofibers 301 discharged by the diffusing unit 240, and includes the deposition member 101, a transporting unit 104, the attracting electrode 112, and an attraction power source 113.

The deposition member 101 is a member on which the nanofibers 301 manufactured through the electrostatic stretching phenomenon are deposited. The deposition member 101 is an elongated sheet-like member which is thin and flexible, and made of materials easily separable from the deposited nanofibers 301. More specifically, an example of the deposition member 101 is an elongated cloth made of aramid fiber. Further, Teflon (registered trademark) coating on the surface of the deposition member 101 is preferable since it enhances removability when removing the deposited nanofibers 301 from the deposition member 101. The deposition member 101 is supplied being wound into a roll from a supplying unit 111.

The transporting unit 104 winds the elongated deposition member 101 and simultaneously unwinds the deposition member 101 from the supplying unit 111, and transports the deposition member 101 together with the deposited nanofibers 301. The transporting unit 104 can wind the nanofibers 301 deposited in a non-woven fabric like state, together with the deposition member 101.

The attracting electrode 112 is a member which attracts the charged nanofibers 301 using an electric field, and is a rectangle plate-like electrode that is a size smaller than the size of the opening at the downstream end of the diffusing unit 240. In a state where the attracting electrode 112 is placed at the opening of the diffusing unit 240, there are spacing between the diffusing unit 240 and the attracting electrode 112. The peripheral portion of the face of the attracting electrode 112 toward the diffusing unit 240 is not sharpened, and is totally rounded. This prevents anomalous electric discharge from occurring.

The attraction power source 113 is a power source for applying an electric potential to the attracting electrode 112. In the present embodiment, a DC power source is used.

The drawing units 102 are apparatuses which are placed in the spacing between the diffusing unit 240 and the attracting electrode 112, and are forcibly draws the gas flow that are separated from the nanofibers 301 and that comes out from the spacing. In the present embodiment, a blower, such as a sirocco fan or an axial flow fan, is used as the drawing units 102. Further, the drawing units 102 are capable of drawing most of the gas flow in which solvent evaporated from the solution 300 is mixed, and transporting the gas flow to solvent collecting apparatuses 106 connected to the drawing units 102.

Figure 2:
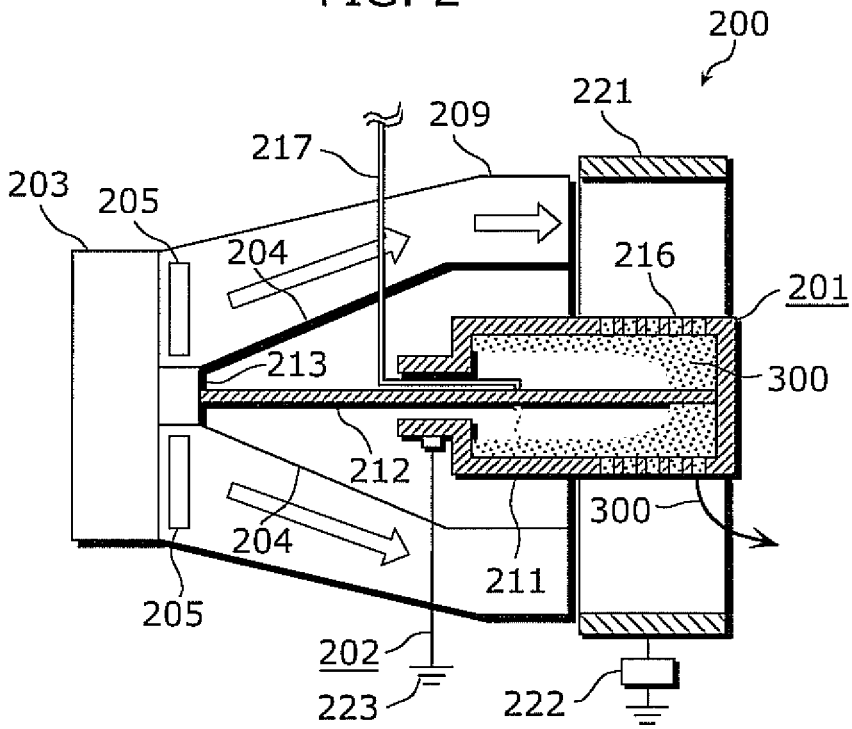
FIG. 2 is a cross-section diagram showing a discharging apparatus.

FIG. 2 is a cross-section diagram of the discharging apparatus.

Figure 3:
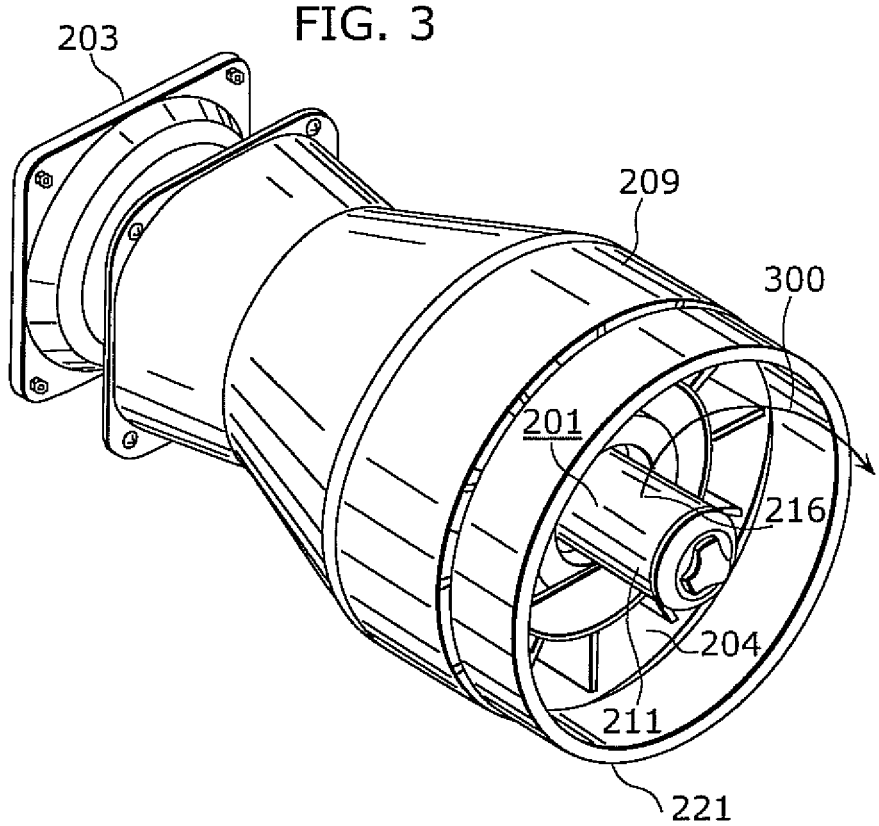
FIG. 3 is a perspective diagram showing the discharging apparatus.

FIG. 3 is a perspective diagram of the discharging apparatus.

The discharging apparatus 200 includes the effusing unit 201, the first charging unit 202, the air channel 209, and the gas flow generating unit 203.

As shown in FIGS. 2 and 3, the effusing unit 201 is an apparatus which effuses the solution 300 into the space. In the present embodiment, the effusing 201 radially effuses the solution 300 by the centrifugal force. The effusing unit 201 includes an effusing body 211, a rotary shaft 212, and a motor 213.

The effusing body 211 is a container which can effuse the solution 300 into the space by the centrifugal force caused by rotation of the effusing body 211 while the solution 300 being supplied inside. The effusing body 211 has a cylindrical shape whose one end is closed, and includes a plurality of effusion holes 216 on its circumferential wall. The effusing body 211 is made of a conductive material so that an electric charge can be applied to the solution 300 contained inside. The effusing body 211 is pivotally supported by a bearing (not shown) provided to a support (not shown).

More particularly, it is preferable that the diameter of the effusing body 211 is set within a range of not less than 10 mm to not more than 300 mm. It is because, if the diameter is too large, causing the gas flow to concentrate the solution 300 or the nanofibers 301 is unlikely. On the other hand, if the diameter is too small, it is necessary to increase the number of rotations of the effusing body 211 so that the solution 300 is ejected by the centrifugal force. This causes problems associated with, for example, extra loads or vibrations of the motor. Further, it is preferable that the diameter of the effusing body 211 is set within a range of not less than 20 mm to not more than 80 mm. Further, it is preferable that the shape of the effusion holes 216 is circular, and that the diameter of the effusion holes 216 is set within a range of not less than 0.01 mm to not more than 2 mm.

However, the shape of the effusing body 211 is not limited to the cylindrical shape, but may be a polygonal column shape having polygonal lateral surfaces, a conical shape, or the like. It may be any shape as long as the solution 300 can be effused through the effusion holes 216 by the centrifugal force caused by the rotation of the effusion holes 216.

The rotary shaft 212 is a shaft which transmits a drive force for rotating the effusing body 211 so as to effuse the solution 300 by the centrifugal force. The rotary shaft 212 has a rod shape and is inserted into the effusing body 211 from other end of the effusing body 211. One end of the rotary shaft 212 is connected with the closed portion of the effusing body 211. The other end of the rotary shaft 212 is connected with a rotary shaft of the motor 213.

The motor 213 is an apparatus which applies a rotation drive force to the effusing body 211 via the rotary shaft 212 for ejecting the solution 300 through the effusion holes 216 by the centrifugal force. It is preferable that the number of rotation of the effusing body 211 is set within a range of not less than a few rpm to not more than 10000 rpm depending on, for example, the bore of the effusion holes 216, viscosity of the solution 300, or types of resin in the solution. When the effusing body 211 is directly driven by the motor 213 as in the present embodiment, the number of rotation of the motor 213 corresponds to the number of rotation of the effusing body 211.

The first charging unit 202 is an apparatus which electrically charges the solution 300 by applying an electric charge to the solution 300. In the present embodiment, the first charging unit 202 includes a charging electrode 221, a charging power source 222, and a grounding unit 223. Further, the effusing body 211 also serves as part of the first charging unit 202.

The charging electrode 221 is a member for inducing electric charges on the effusing body 211, which is provided near the charging electrode 221 and is grounded, by having a voltage higher than ground. The charging electrode 221 is an annular member provided so as to surround the tip of the effusing body 211. Further, the charging electrode 221 also serves as the air channel 209 which guides gas flow generated from the gas flow generating unit 203 to the guiding unit 206.

The size of the charging electrode 221 needs to be larger than the diameter of the effusing body 211. It is preferable that the diameter of the charging electrode 221 is set in the range from not less than 200 mm to not more than 800 mm.

The charging power source 222 is a power source which can apply a high voltage to the charging electrode 221. It is preferable that, in general, the charging power source 222 is a DC power source. In particular, a DC power source is preferable, for example, in the case where the nanofiber manufacturing apparatus 100 is not influenced by the charge polarity of the nanofibers 301 to be manufactured, or in the case where the manufactured nanofibers 301 are collected on an electrode using the electric charge of the nanofibers 301. Further, in the case where the charging power source 222 is a DC power source, it is preferable to set a voltage to be applied by the charging power source 222 to the charging electrode 221 within the range from not less than 10 KV to not more than 200 KV. In particular, the electric field strength between the effusing body 211 and the charging electrode 221 is important; and thus, it is preferable to set a voltage to be applied or to place the charging electrode 221 such that the electric field strength is 1 KV/cm or more. The shape of the charging electrode 221 is not limited to an annular shape, but may be a polygonal shaped annular member having a polygonal cross-section.

The grounding unit 223 is a member which is electrically connected to the effusing body 211 and can maintain the effusing body 211 at a ground potential level. One end of the grounding unit 223 serves as a brush so that an electric connection state can be maintained even when the effusing body 211 is in a rotating state. The other end of the grounding unit 223 is connected to the ground.

As in the present embodiment, if an induction method is used in the first charging unit 202, it is possible to apply an electric charge to the solution 300 while the effusing body 211 is maintained at the ground potential level. When the effusing body 211 is in the ground potential level, there is no need to electrically isolate, from the effusing body 211, members such as the rotary shaft 212 and the motor 213 that are connected to the effusing body 211. This is preferable because it allows a simple structure of the effusing unit 201.

It may be that a power source is connected to the effusing body 211, the effusing body 211 is maintained at a high voltage, and the charging electrode 221 is grounded, so as to serve as the first charging unit 202 and to apply an electric charge to the solution 300. Further, it may be that the effusing body 211 is formed of an insulating material, an electrode which directly contacts the solution 300 stored in the effusing body 211 is provided inside the effusing body 211, and an electric charge is applied to the solution 300 using the electrode.

The gas flow generating unit 203 is an apparatus which generates gas flow for changing the traveling direction of the solution 300 effused from the effusing body 211 into the direction guided by the guiding unit 206. The gas flow generating unit 203 is provided at the rear side of the motor 213, and generates gas flow directed toward the tip of the effusing body 211 from the motor 213. The gas flow generating unit 203 is capable of generating force which changes, into the axial direction of the effusing body 211, the direction of the solution 300 radially effused from the effusing body 211, before the solution 300 reaches the charging electrode 221. In FIG. 2, the gas flow are indicated by white arrows. In the present embodiment, a blower including an axial flow fan which forcibly blows atmosphere around the discharging apparatus 200 is used as the gas flow generating unit 203.

The gas flow generating unit 203 may be made of other types of blowers, such as a sirocco fan. Further, the gas flow generating unit 203 may change the direction of the effused solution 300 by introducing high pressure gas. In addition, the gas flow generating unit 203 may generate gas flow inside the guiding unit 206 using the drawing unit 102, the second gas flow generating unit 232, or the like. In this case, the gas flow generating unit 203 does not include an apparatus for actively generating gas flow; however, in the embodiments according to the present invention and any other conceivable embodiments, it is considered that the gas flow generating unit 203 is present since gas flow is generated inside the guiding unit 206. In addition, the gas flow generating unit 203 is considered to be present also in the case where the gas flow is generated inside the guiding unit 206 through attraction by the drawing unit 102 without having the gas flow generating unit 203. In addition, the gas flow generating unit 203 is considered to be present also in the case where the gas flow is generated inside the guiding unit 206 through attraction by the drawing unit 102 without having the gas flow generating unit 203.

The air channel 209 are ducts for guiding the gas flow generated by the gas flow generating unit 203 to an area close to the effusing body 211. The gas flow guided by the air channel 209 intersects with the solution 300 effused from the effusing body 211, thereby changing the traveling direction of the solution 300.

The discharging apparatus 200 further includes a gas flow controlling unit 204 and a heating unit 205.

The gas flow controlling unit 204 has a function to control the gas flow generated by the gas flow generating unit 203 such that the gas flow does not hit the effusion holes 216. In the present embodiment, an air path, which guides the gas flow to travel to a specific area, is used as the gas flow controlling unit 204. The gas flow controlling unit 204 prevents the gas flow from directly hitting the effusion holes 216; and thus, it is possible to prevent, as much as possible, the solution 300 effused from the effusion holes 216 from evaporating early and blocking the effusion holes 216. As a result, the solution 300 can be stably and continuously ejected. Note that the gas flow controlling unit 204 may be a windshield wall which is provided upstream of the effusion holes 216 and prevents the gas flow from reaching near the effusion holes 216.

The heating unit 205 is a heating source which heats gas forming the gas flow generated by the gas flow generating unit 203. In the present embodiment, the heating unit 205 is an annular heater provided inside the guiding unit 206, and is capable of heating gas which passes through the heating unit 205. By heating the gas flow using the heating unit 205, evaporation of the solution 300 effused into the space is facilitated, thereby effectively manufacturing the nanofibers.

Next, a method for manufacturing the nanofibers 301 using the nanofiber manufacturing apparatus 100 is described.

First, the gas flow generating unit 203 and the second gas flow generating unit 232 generate gas flow inside the guiding unit 206 and the air channel 209. At the same time, the drawing unit 102 draws the gas flow generated inside the guiding unit 206.

Next, the solution 300 is supplied into the effusing body 211 of the effusing unit 201. The solution 300 is stored in a separate tank (not shown), and is supplied into the effusing body 211 from the other end of the effusing body 211 via a supply path 217 (see FIG. 2).

Next, while an electric charge is applied to the solution 300 stored in the effusing body 211 by the charging power source 222 (first charging process), the effusing body 211 is rotated by the motor 213, so that the charged solution 300 is effused through the effusion holes 216 by the centrifugal force (effusing process).

The traveling direction of the solution 300 effused radially in a radial direction of the effusing body 211 is changed by the gas flow, and the solution 300 is guided by the gas flow through the air channel 209. The nanofibers 301 are manufactured from the solution 300 through the electrostatic stretching phenomenon (nanofiber manufacturing process) and are discharged from the discharging apparatus 200. Further, the gas flow, which is heated by the heating unit 205, guides the traveling of the solution 300 and facilitates the evaporation of the solvent by applying heat to the solution 300. The nanofibers 301 thus discharged from the discharging apparatus 200 are transported inside the guiding unit 206 by the gas flow (transporting process).

Following this, the nanofibers 301, which passes through the inside of the compressing unit 230, are accelerated by the jet flow of the high pressure gas, and are gradually compressed as the inside of the compressing unit 230 becomes narrower. Then, the nanofibers 301 become a high density state and reaches the diffusing unit 240 (compressing process).

Here, the nanofibers 301 which have been transported by the gas flow may have less electric charge; and thus, the second charging unit 207 forcibly charges the nanofibers 301 to the same polarity (second charging process).

The nanofibers 301 transported to the diffusing unit 240 reduces its traveling speed rapidly, and are evenly dispersed (diffusing process).

In such a state, the attracting electrode 112 placed at the opening of the diffusing unit 240 attracts the nanofibers 301 because the attracting electrode 112 is charged to a polarity opposite to the charge polarity of the nanofibers 301. Because the deposition member 101 is placed between the nanofibers 301 and the attracting electrode 112, the nanofibers 301 attracted to the attracting electrode 112 are deposited on the deposition member 101 (collecting process).

On the other hand, the drawing units 102 placed near the spacing between the attracting electrode 112 and the diffusing unit 240 draws the solvent that is an evaporated component together with the gas flow (drawing process).

Accordingly, the solvent included in the solution 300 evaporates inside the guiding unit 206; however, the gas flow is present inside the guiding unit 206 and always flows until it is drawn and collected by the drawing unit 102. Therefore, vapor of the solvent does not stay inside the guiding unit 206. Therefore, the inside of the guiding unit 206 does not exceed the explosion limit. As a result, it is possible to manufacture the nanofibers 301 while keeping a safe condition.

Further, a flammable solvent can be used. This expands the kinds of organic solvents that can be used as a solvent, and allows selection of an organic solvent that has less negative effect on human health. In addition, manufacturing efficiency of the nanofibers 301 can be improved by selecting an organic solvent having high evaporation efficiency as a solvent.

Further, the nanofibers 301 are deposited evenly on the deposition member 101 because the nanofibers 301 are attracted to the attracting electrode 112 after being evenly diffused and dispersed by the diffusing unit 240. Accordingly, in the case where the deposited nanofibers 301 are used as a nonwoven fabric, it is possible to obtain a nonwoven fabric having a stable performance across the entire surface. Further, in the case where the deposited nanofibers 301 are spun, yarn with stable performance can be obtained.

Examples of resin constituting the nanofibers 301 include polypropylene, polyethylene, polystyrene, polyethylene oxide, polyethylene terephthalate, polybutylene terephthalate, polyethylene naphthalate, poly-m-phenylene terephthalate, poly-p-phenylene isophthalate, polyvinylidene fluoride, polyvinylidene fluoride-hexafluoropropylene copolymer, polyvinyl chloride, polyvinylidene chloride-acrylate copolymer, polyacrylonitrile, polyacrylonitrile-methacrylate copolymer, polycarbonate, polyarylate, polyester carbonate, nylon, aramid, polycaprolactone, polylactic acid, polyglycolic acid, collagen, polyhydroxybutyric acid, polyvinyl acetate, and polypeptide. Further, one type selected from the above may be used, or various types may be mixed. Note that these are just examples, and the present invention should not be limited to the above resins.

Examples of solvents used for the solution 300 include methanol, ethanol, 1-propanol, 2-propanol, hexafluoroisopropanol, tetraethylene glycol, triethylene glycol, dibenzyl alcohol, 1,3-dioxolane, 1,4-dioxane, methyl ethyl ketone, methyl isobutyl ketone, methyl-n-hexyl ketone, methyl-n-propyl ketone, diisopropyl ketone, diisobutyl ketone, acetone, hexafluoroacetone, phenol, formic acid, methyl formate, ethyl formate, propyl formate, methyl benzoate, ethyl benzoate, propyl benzoate, methyl acetate, ethyl acetate, propyl acetate, dimethyl phthalate, diethyl phthalate, dipropyl phthalate, methyl chloride, ethyl chloride, methylene chloride, chloroform, o-chlorotoluene, p-chlorotoluene, chloroform, carbon tetrachloride, 1,1-dichloroethane, 1,2-dichloroethane, trichloroethane, dichloropropane, dibromoethane, dibromopropane, methyl bromide, ethyl bromide, propyl bromide, acetic acid, benzene, toluene, hexane, cyclohexane, cyclohexanone, cyclopentane, o-xylene, p-xylene, m-xylene, acetonitrile, tetrahydrofuran, N,N-dimethylformamide, pyridine, and water. Further, one type selected from the above may be used, or various types may be mixed. Note that these are just examples, and the present invention should not be limited to the above solvents.

In addition, some additive agent such as aggregate or plasticizing agent may be added to the solution 300. Examples of additive agent include oxides, carbides, nitrides, borides, silicides, fluorides, and sulfides. However, in view of thermal resistance, workability, and the like, oxides are preferable. Examples of oxides include $Al_2O_3$, $SiO_2$, $TiO_2$, $Li_2O$, $Na_2O$, MgO, CaO, SrO, BaO, $B_2O_3$, $P_2O_5$, $SnO_2$, $ZrO_2$, $K_2O$, $Cs_2O$, ZnO, $Sb_2O_3$, $As_2O_3$, $CeO_2$, $V_2O_5$, $Cr_2O_3$, MnO, $Fe_2O_3$, CoO, NiO, $Y_2O_3$, $Lu_2O_3$, $Yb_2O_3$, $HfO_2$, and $Nb_2O_5$. Further, one type selected from the above may be used, or various types may be mixed. Note that these are just examples, and the present invention should not be limited to the above additive agents.

Desirable mixing ratio of solvent and polymeric substance is that the polymeric resin constituting the nanofiber is selected in the range of not less than 1 vol % and not more than 50 vol %, and the organic solvent that is evaporable solvent is selected in the range of not less than 50 vol % and not more than 99 vol %.

As described, even if the solution 300 contains the solvent of 50 vol % or more as described above, the solvent evaporates sufficiently because solvent vapor does not stay due to the gas flow. This allows electrostatic stretching phenomenon to occur. Accordingly, the nanofibers 301 are manufactured from the state where the polymer that is the solvent is thin, thinner nanofibers 301 can be manufactured. Further, the adjustable range of the solution 300 increases, allowing wider range of performances of the manufactured nanofibers 301.

Figure 4:
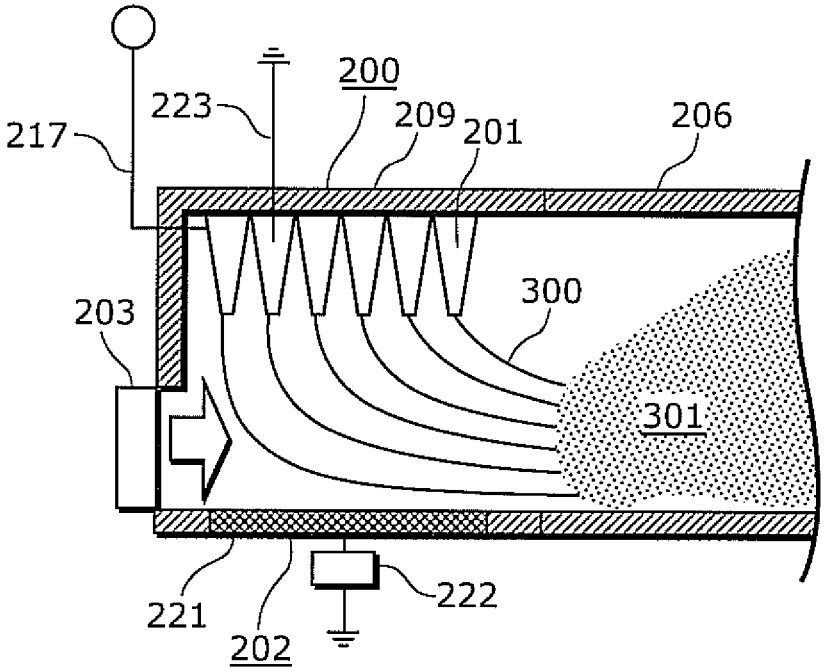
FIG. 4 is a cross-section diagram schematically showing another example of the discharging apparatus.

Note that in the present embodiment, the solution 300 is effused by the centrifugal force; however, the present invention is not limited to this. For example, as shown in FIG. 4, the first charging unit 202 is configured in such a manner that multiple nozzles made of an conductive substance are provided to the air channel 209 that is rectangle, and the charging electrode 221 is provided on the opposing side of the air channel 209. Further, the gas flow generating unit 203 is provided at the end of the air channel 209. The discharging device 200 may have such a configuration.

Figure 5:
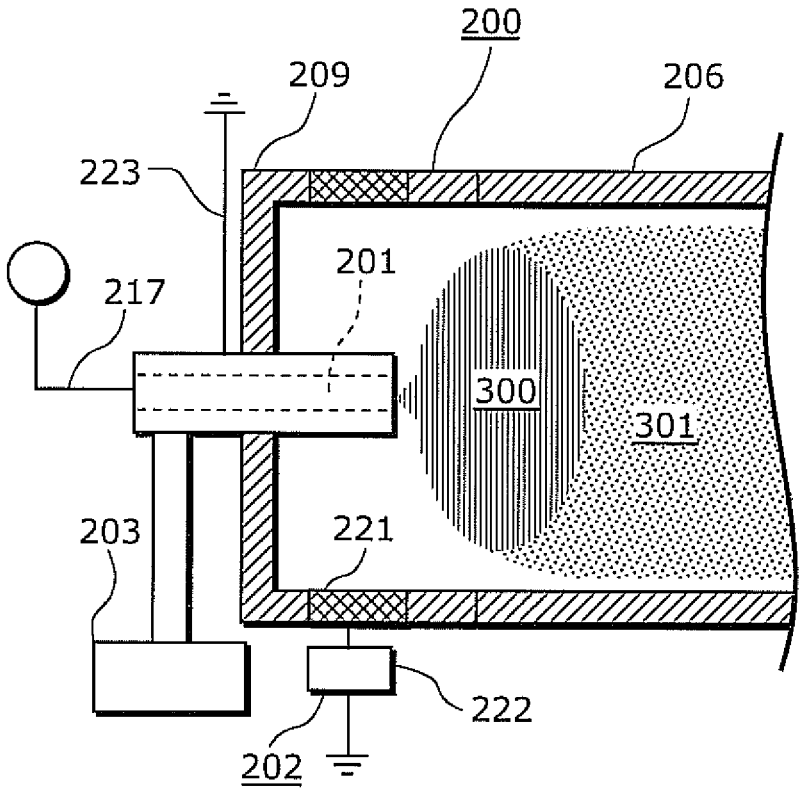
FIG. 5 is a cross-section diagram schematically showing another example of a discharging apparatus.

Further, as shown in FIG. 5, a two-fluid nozzle made of a conductive substance is provided at the closed end of the cylindrical air channel 209 in a protruding manner, and the annular charging electrode 221 is provided so as to surround the two-fluid nozzle (the two-fluid nozzle has a hole for effusing the solution 300, and a hole provided nearby for effusing high pressure gas, and atomizes the solution 300 by blowing the high pressure gas to the solution 300). The two-fluid nozzle has an inner tube which serves as the effusing unit 201 for effusing the solution 300, and an outer tube which atomizes the solution 300 and which also serves as the gas flow generating unit 203 for generating gas flow inside the air channel 209 and the guiding unit 206. The discharging device 200 may have such a configuration.

Note that in the present embodiment, a blower is used as an example of the gas flow generating unit 203; however, the present invention is not limited to this. For example, in the case where an opening is provided at an appropriate portion of the discharging apparatus 200 and the drawing unit 102 performs the drawing, the opening serves as the gas flow generating unit 203 when the surrounding atmosphere is drawn through the opening and the gas flow is generated inside the guiding unit 206.

Further, the compressing unit 230 and the second charging unit 207 may be omitted as necessary.

Further, in FIG. 1, in the case where the compressing unit 230 is omitted, and the guiding unit 206 and the diffusing unit 240 are directly connected, explosions do not occur even when the flammable solvents are used. In particular, placing the drawing units 102 near the deposition member 101 makes it possible to maintain the concentration level of the solvent near the deposition member 101 below the explosion limit above which explosions are caused by the solvent. It also allows the manufactured and charged nanofibers to be evenly deposited on the deposition member 101. Further, it may be that the second charging unit is provide on the inner wall of the guiding unit 206 so that the charged nanofibers are further charged to the same polarity.

Further, the attracting electrode 112 is connected to the attraction power source 113; however, the same advantageous effects can be obtained even if the attracting electrode 112 is ground and the charged nanofibers are collected.

Embodiment 2

Next, Embodiment 2 according to the present invention is described with reference to the drawings.

Figure 6:
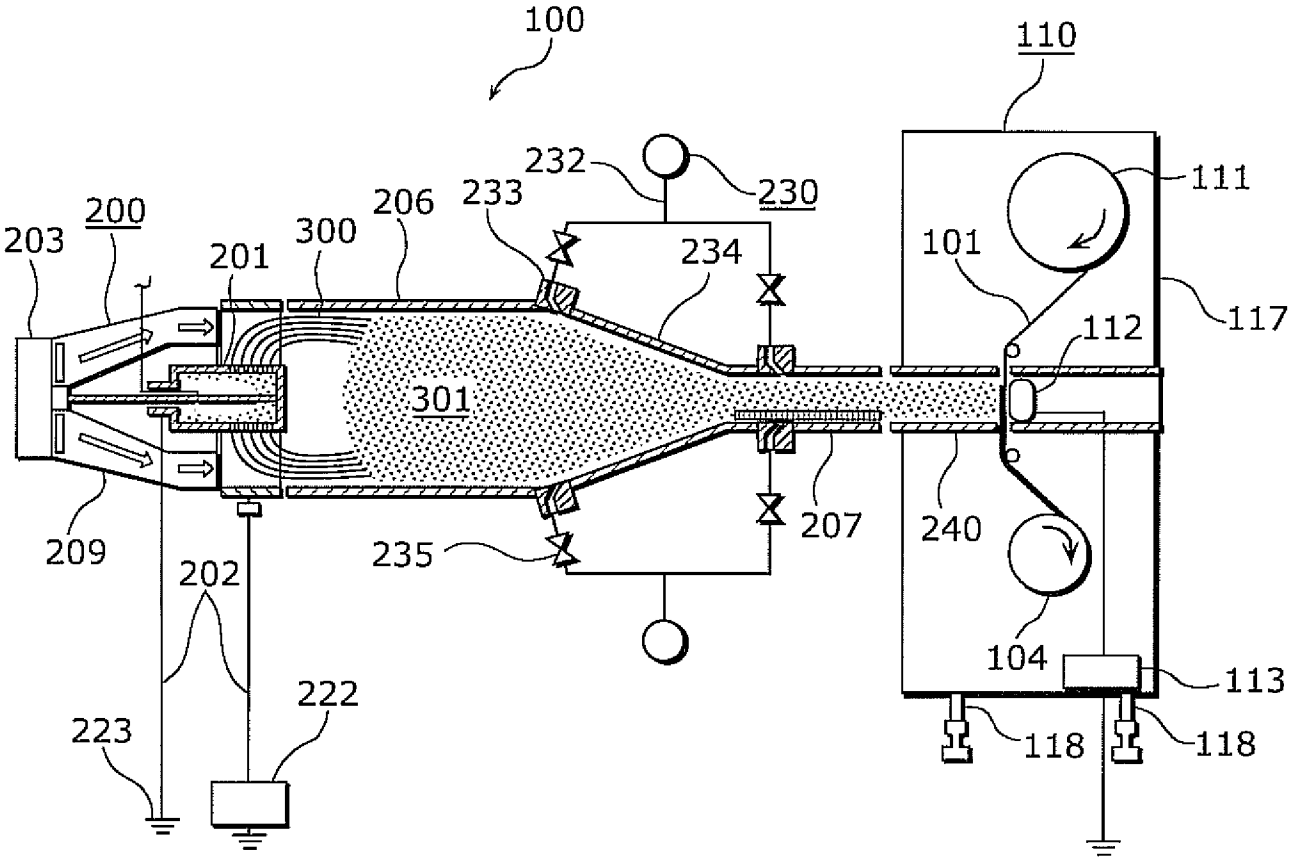
FIG. 6 is a cross-section diagram schematically showing a state where a discharging apparatus and a first collecting apparatus are mounted.

FIG. 6 is a cross-section diagram schematically showing a nanofiber manufacturing apparatus according to Embodiment 2 of the present invention.

As shown in FIG. 6, a nanofiber manufacturing apparatus 100 includes a discharging apparatus 200 which manufactures nanofibers and discharges the manufactured nanofibers, and a collecting apparatus 100 which collects the nanofibers discharged from the discharging apparatus 200.

The discharging apparatus 200 includes an effusing unit 201, a first charging unit 202, a guiding unit 206, and a gas flow generating unit 203.

Figure 7:
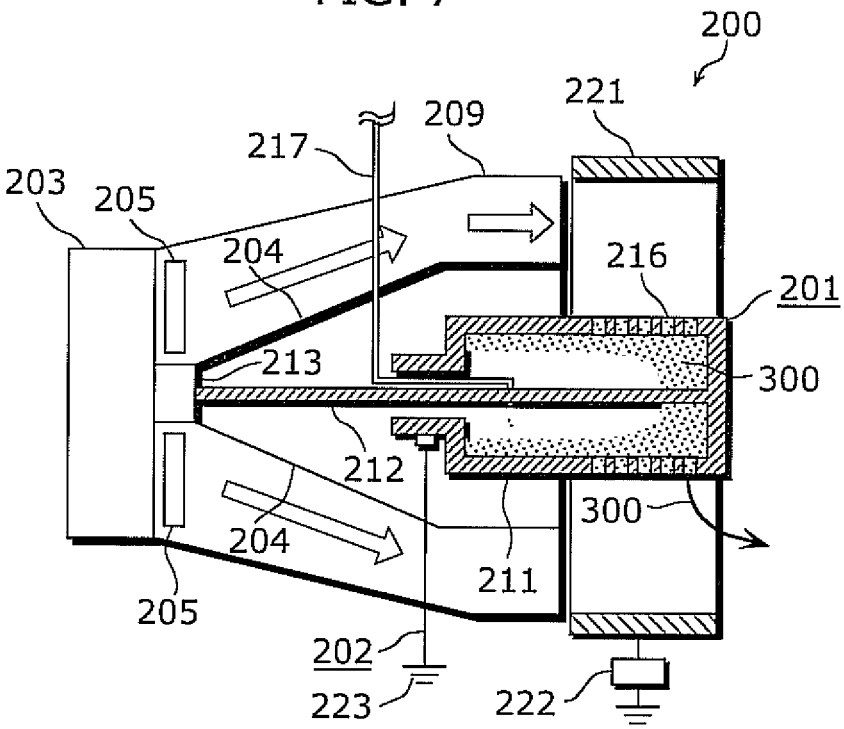
FIG. 7 is a cross-section diagram showing proximity of an effusing apparatus.
Figure 8:
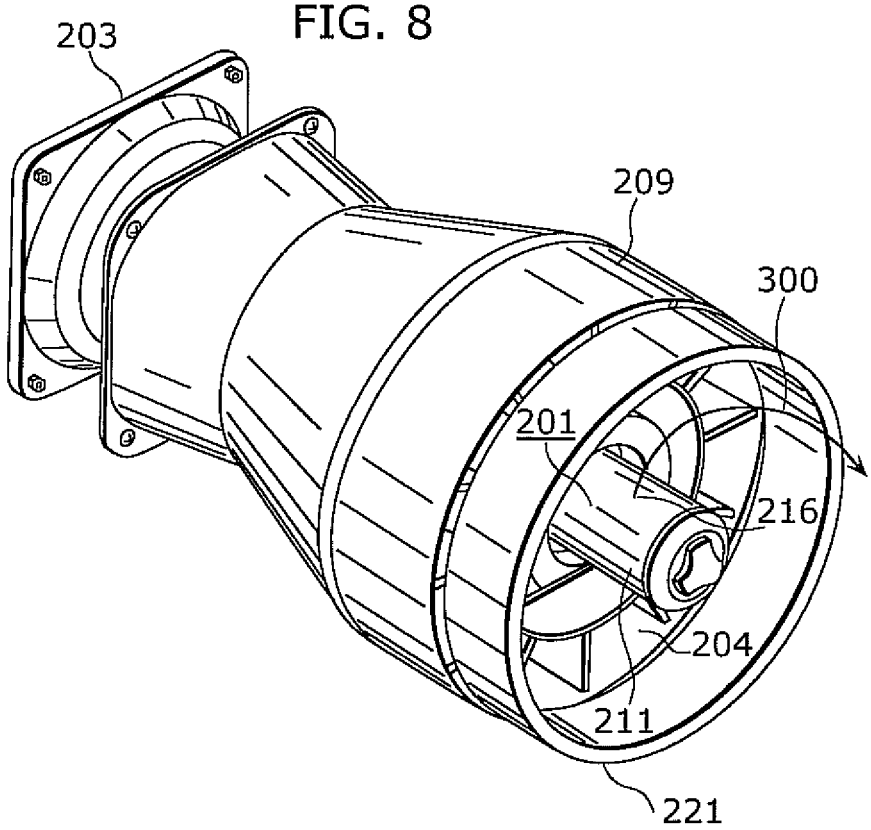
FIG. 8 is a perspective diagram showing the proximity of the effusing apparatus.

The effusing unit 201 is an apparatus which effuses solution as a raw material 300 into the space. In the present embodiment, an apparatus which effuses the solution 300 radially by the centrifugal force is used as the effusing unit 201. The effusing unit 201 includes an effusing body 211, a rotary shaft 212, and a motor 213 as shown in FIGS. 7 and 8.

The effusing body 211 is a container which can effuse the solution 300 into the space by the centrifugal force caused by rotation of the effusing body 211 while the solution 300 being supplied inside. The effusing body 211 has a cylindrical shape whose one end is closed, and includes a plurality of effusion holes 216 on its circumferential wall. The effusing body 211 is formed of a conductive material so that an electric charge can be applied to the solution 300 contained inside, and also serves as an element constituting the first charging unit 202. The effusing body 211 is pivotally supported by a bearing (not shown) provided to a support (not shown), and does not vibrate even if it rotates at a high speed.

More particularly, it is preferable that the diameter of the effusing body 211 is set within a range of not less than 10 mm to not more than 300 mm. It is because, if the diameter is too large, causing the gas flow to concentrate the solution 300 or the nanofibers 301 is unlikely. It is also because, if the weight balance is unbalanced even slightly, such as the case of the rotary shaft of the effusing body 211 is decentered, a significant vibration is caused, requiring a structure to support the effusing body 211 firmly to suppress such a shake. On the other hand, if the diameter is too small, it is necessary to increase the number of rotations of the effusing body 211 so that the solution 300 is effused by the centrifugal force. This causes problems associated with, for example, extra loads or vibrations of the motor. Further, it is preferable that the diameter of the effusing body 211 is set within a range of not less than 20 mm to not more than 100 mm. Further, it is preferable that the shape of the effusion hole 216 is circular. The diameter of the effusion hole 216 is preferably set within a range of not less than 0.01 mm to not more than 2 mm.

However, the shape of the effusing body 211 is not limited to the cylindrical shape, but may be a polygonal column shape having polygonal lateral surfaces, a conical shape, or the like. It may be any shape as long as the solution 300 can be effused through the effusion holes 216 by the rotation of the effusion holes 216. Further, the shape of the effusion holes 216 is not limited to circular, but may be polygonal, star like shape, or the like.

The rotary shaft 212 is a shaft which transmits a drive force for rotating the effusing body 211 so as to effuse the solution 300 by the centrifugal force. The rotary shaft 212 has a rod shape and is inserted into the effusing body 211 from other end of the effusing body 211. One end of the rotary shaft 212 is connected with the closed portion of the effusing body 211. Further, the other end of the rotary shaft 212 is connected to a rotary shaft of the motor 213. The rotary shaft 212 has an insulating portion (not shown) made of an insulating material so as to prevent conduction between the effusing body 211 and the motor 213.

The motor 213 is an apparatus which applies a rotation drive force to the effusing body 211 via the rotary shaft 212 for effusing the solution 300 through the effusion holes 216 by the centrifugal force. It is preferable that the number of rotation of the effusing body 211 is set within a range of not less than a few rpm to not more than 10000 rpm depending on, for example, the bore of the effusion holes 216, viscosity of the solution 300, or types of resin in the solution. When the effusing body 211 is directly driven by the motor 213 as in the present embodiment, the number of rotation of the motor 213 corresponds to the number of rotation of the effusing body 211.

The first charging unit 202 is an apparatus which electrically charges the solution 300 by applying an electric charge to the solution 300. In the present embodiment, the first charging unit 202 is an apparatus which generates an inductive charge and applies the charge to the solution 300, and includes a charging electrode 221, a charging power source 222, and a grounding unit 223. Further, the effusing body 211 also serves as part of the first charging unit 202.

The charging electrode 221 is a member for inducing charges on the effusing body 211, which is provided near the charging electrode 221 and is grounded, by having a voltage higher (or lower) than ground. The charging electrode 221 is an annular member provided so as to surround the tip of the effusing body 211. Further, the charging electrode 221 also serves as air channel 209 which guide gas flow generated by the gas flow generating unit 203 to the guiding unit 206.

The charging electrode 221 needs to be larger in diameter than the effusing body 211. It is preferable that the diameter of the charging electrode 221 is set in the range from not less than 200 mm to not more than 800 mm. The shape of the charging electrode 221 is not limited to an annular shape, but the charging electrode 221 may be a polygonal shaped annular member having a polygonal cross-section.

The charging power source 222 is a power source which can apply a high voltage to the charging electrode 221. The charging power source 222 is a DC power source, and is an apparatus which can set the voltage applied to the charging electrode 221 (with ground potential as a reference) and its polarity.

Preferable voltage to be applied by the charging power source 222 to the charging electrode 221 is set within the range from not less than 10 KV to not more than 200 KV. In particular, the electric field strength between the effusing body 211 and the charging electrode 221 is important; and thus, it is preferable to set a voltage to be applied or to place the charging electrode 221 such that the electric field strength is 1 KV/cm or more.

The grounding unit 223 is a member which is electrically connected to the effusing body 211 and can maintain the effusing body 211 at a ground potential level. One end of the grounding unit 223 serves as a brush so that electric connection state can be maintained even when the effusing body 211 is in a rotating state. The other end is connected to the ground.

As in the present embodiment, if an induction method is used in the first charging unit 202, it is possible to apply an electric charge to the solution 300 while the effusing body 211 is maintained at the ground potential level. When the effusing body 211 is in the ground potential level, there is no need to take measures relative to high voltage between the effusing body 211 and members such as the rotary shaft 212 or the motor 213 that are connected to the effusing body 211. This is preferable since it allows a simple structure of the effusing unit 201.

It may be that a power source is directly connected to the effusing body 211, the effusing body 211 is maintained at a high voltage, and the charging electrode 221 is grounded, so as to serve as the first charging unit 202 and to apply an electric charge to the solution 300. Further, it may be that the effusing body 211 is formed of an insulating material, an electrode which directly contacts the solution 300 stored in the effusing body 211 is provided inside the effusing body 211, and an electric charge is applied to the solution 300 using the electrode.

The gas flow generating unit 203 is an apparatus which generates gas flow for changing the traveling direction of the solution 300 effused from the effusing body 211 into the direction guided by the guiding unit 206. The gas flow generating unit 203 is provided at the rear side of the motor 213, and generates gas flow directed toward the tip of the effusing body 211 from the motor 213. The gas flow generating unit 203 is capable of generating force which changes, into the axial direction of the effusing body 211, the direction of the solution 300 radially effused from the effusing body 211, before the solution 300 reaches the charging electrode 221. In FIG. 7, the gas flow are indicated by white arrows. In the present embodiment, a blower including an axial flow fan which forcibly blows atmosphere around the discharging apparatus 200 is used as the gas flow generating unit 203.

The gas flow generating unit 203 includes the air channel 209 which are ducts for guiding the generated gas flow to an area close to the effusing body 211 without dispersing the gas flow. The gas flow guided by the air channel 209 intersects with the solution 300 effused from the effusing body 211, thereby changing the traveling direction of the solution 300.

The gas flow generating unit 203 also includes a gas flow controlling unit 204 and a heating unit 205.

The gas flow controlling unit 204 has a function to control the gas flow generated by the gas flow generating unit 203 such that the gas flow does not hit the effusion holes 216. In the present embodiment, an air channel, which guides the gas flow to travel to a specific area, is used as the gas flow controlling unit 204. The gas flow controlling unit 204 prevents the gas flow from directly hitting the effusion holes 216; and thus, it is possible to prevent, as much as possible, the solution 300 effused from the effusion holes 216 from evaporating early and blocking the effusion holes 216. As a result, the solution 300 can be stably and continuously effused. Note that the gas flow controlling unit 204 may be a windshield wall which is provided upstream of the effusion holes 216 and prevents the gas flow from reaching near the effusion holes 216.

The heating unit 205 is a heating source which heats gas forming the gas flow generated by the gas flow generating unit 203. In the present embodiment, the heating unit 205 is an annular heater provided inside the air channel 209, and is capable of heating gas which passes through the heating unit 205. By heating the gas flow using the heating unit 205, evaporation of the solution 300 effused into the space is facilitated, thereby effectively manufacturing the nanofibers.

The gas flow generating unit 203 may be made of other types of blowers, such as a sirocco fan. Further, the gas flow generating unit 203 may change the direction of the effused solution 300 by introducing high pressure gas. In addition, the gas flow generating unit 203 may generate gas flow inside the guiding unit 206 using a second gas flow generating unit 232 or the collecting apparatus 110 that will be described later. In this case, the gas flow generating unit 203 does not include an apparatus for actively generating gas flow; however, in the present embodiment, it is considered that the gas flow generating unit 203 is present since gas flow is generated inside the air channel 209.

The guiding unit 206 is a duct constituting an air channel which guides the manufactured nanofibers 301 to an area close to the collecting apparatus 110. The guiding unit 206 has an end connected to an end of the air channel 209, and is a tubular member which can guide all the gas flow and the nanofibers 301 effused from the effusing unit 201 and being manufactured. In the present embodiment, the compressing unit 230 that will be described later is also included in the guiding unit 206 in a sense that it also guides the nanofibers 301.

The compressing unit 230 is an apparatus which has a function of compressing space where the nanofibers 301 transported by the gas flow are present (inside the guiding unit 206) to increase density of the nanofibers 301 in the space. The compressing unit 230 includes a second gas flow generating unit 232 and a compression duct 234.

The compression duct 234 is a cylindrical member which gradually narrows the space where the nanofibers 301 transported inside the guiding unit 206 are present. The compression duct 234 includes, on its circumferential wall, gas flow inlets 233 which allow the gas flow generated by the second gas flow generating unit 232 to be guided inside the compression duct 234. The connection portion of the compression duct 234 with the guiding unit 206 has an area corresponding to an area of the lead-out end of the guiding unit 206. The lead-out end of the compression duct 234 has an area smaller than the area of the lead-out end of the guiding unit 206. Thus, the compression duct 234 has a funnel shape as a whole, which allows compression of the nanofibers 301 introduced to the compression duct 234 and the gas flow.

Further, the upstream (lead-in) end of the compressing unit 230 has an annular shape which matches the shape of the end of the guiding unit 206 On the other hand, the downstream end (ejection side) of the compressing unit 230 also has an annular shape.

The second gas flow generating unit 232 is an apparatus which generates gas flow by introducing high pressure gas into the compression duct 234. In the present embodiment, the second gas flow generating unit 232 includes a tank (cylinder) which can store high pressure gas, and a gas outlet unit having valves 235 for adjusting pressure of the high pressure gas in the tank Further, a second charging unit 207 is mounted inside the guiding unit 206.

The second charging unit 207 is an apparatus which has a function of increasing electric charges of the charged nanofibers 301 and charging the electrically neutral nanofibers 301 resulting from neutralization. The second charging unit 207 also has a function of neutralizing charges of the charged nanofibers 301. In the present embodiment, the second charging unit 207 is mounted on the inner wall of the compressing unit 230. Examples of the second charging unit 207 include an apparatus which increases the charge of the charged nanofibers 301 by discharging ions or particles having the same polarity as that of the charged nanofibers 301, and can neutralize the nanofibers 301 by discharging, into the space, the ions or particles having the opposite polarity. More specifically, the second charging unit 207 may utilize any types of methods, such as a corona discharge type, voltage applying type, AC type, stationary DC type, pulsed DC type, self discharge type, soft x-ray type, ultraviolet ray type, or radiation type.

The nanofiber manufacturing apparatus 100 includes a first collecting apparatus 110 which attracts the nanofibers 301 by an electric field and a second collecting apparatus 110 which attracts the nanofibers 301 by the gas flow.

Figure 9:
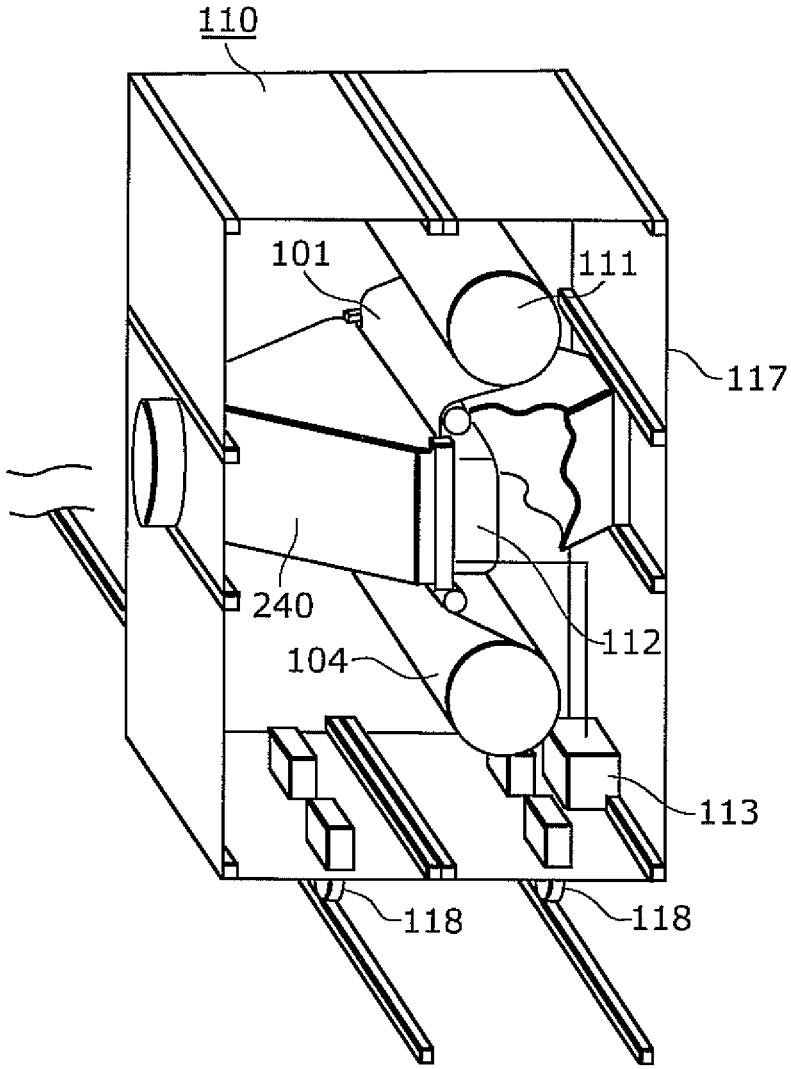
FIG. 9 is a perspective diagram of a first collecting apparatus with some parts of a body omitted.

As shown in FIGS. 6 and 9, the first collecting apparatus 110 includes a deposition member 101, a supplying unit 111, a transporting unit 104, an attracting electrode 112 serving as an attracting apparatus, an attraction power source 113 serving as an attracting apparatus, and a body 117.

The deposition member 101 is a member on which the traveling nanofibers manufactured by electrostatic stretching phenomenon are deposited. The deposition member 101 is an elongated sheet-like member which is thin and flexible, and made of materials easily separable from the deposited nanofibers 301. More specifically, an example of the deposition member 101 is an elongated cloth made of aramid fiber. Further, Teflon (registered trademark) coating on the surface of the deposition member 101 is preferable since it enhances removability when removing the deposited nanofibers 301 from the deposition member 101.

The supplying unit 111 is an apparatus which can sequentially supply the deposition member 101 wound around a winding member, and is provided with a tensioner so that the deposition member 101 can be supplied in a predetermined tension.

The transporting unit 104 winds the elongated deposition member 101 and simultaneously unwinds the deposition member 101 from the supply unit 111, and collects the deposition member 101 together with the deposited nanofibers 301. The transporting unit 104 can wind the nanofibers 301 deposited in a non-woven fabric like state, together with the deposition member 101.

The attracting electrode 112 is a conductive member having an electric potential maintained by the attraction power source 113 at a predetermined level relative to the ground. Application of an electric potential to the attracting electrode 112 generates an electric field in the space. The attracting electrode 112 is a rectangle plate-like member that has no protruding portion for preventing electric discharge and has rounded corners.

The attraction power source 113 is a DC power source which can maintain the attracting electrode 112 at a predetermined potential relative to the ground. Further, the attraction power source 113 is capable of changing positive and negative electric potentials (including ground potential) applied to the attracting electrode 112.

The body 117 is a member in which the deposition member 101, the supplying unit 111, the transporting unit 104, the attracting electrode 112, and the attraction power source 113 are integrally mounted. In the present embodiment, the body 117 is a box member capable of containing the deposition member 101, the supplying unit 111, the transporting unit 104, the attracting electrode 112, and the attraction power source 113 inside.

Further, the diffusing unit 240 is mounted inside the body 117, and wheels 118 are provided at the bottom of the body 117.

The diffusing unit 240 is a duct which widely diffuses and disperses the nanofibers 301 which has become a high density state be being compressed by the compressing unit 230. The diffusing unit 240 is a hood shaped member which decelerates the nanofibers 301 accelerated by the compressing unit 230. The diffusion unit 240 has an opening at the upstream end to which the gas flow is introduced, and a rectangular opening at the downstream end through which the gas flow is discharged. The area of the opening at the downstream end is greater than the area of the opening at the upstream end. The diffusing unit 240 has a shape having an area which gradually increases from the opening at the upstream end toward the opening at the downstream end. The opening of the downstream end has a width approximately same as that of the deposition member 101.

By the gas flow traveling from the smaller-area lead-in side of the diffusing unit 240 toward the larger-area lead-out side of the diffusing unit 240, the nanofibers 301 which are in a high density state turns into a low density state rapidly and are dispersed. At the same time, the velocity of the gas flow decreases in proportion to the cross-section area of the diffusing unit 240. Therefore, the traveling speed of the nanofibers 301 which are transported by the gas flow also decreases together with the decrease in the flow velocity of the gas flow. Here, the nanofibers 301 are gradually diffused evenly according to the increase in the cross section area of the diffusing unit 240. Accordingly, it is possible to evenly deposit the nanofibers 301 on the deposition member 101. Further, a state is made where the nanofibers 301 are not transported by the gas flow, that is, the state where the gas flow and the nanofibers 301 are separated; and thus, the charged nanofibers 301 are attracted to the attracting electrode 112 which has an opposite polarity, without being influenced by the gas flow.

The wheels 118 are provided for enabling the first collecting apparatus 110 to move, and are pivotally mounted at the bottom of the body 117. In the present embodiment, the wheels 118 rotates on rails.

Figure 10:
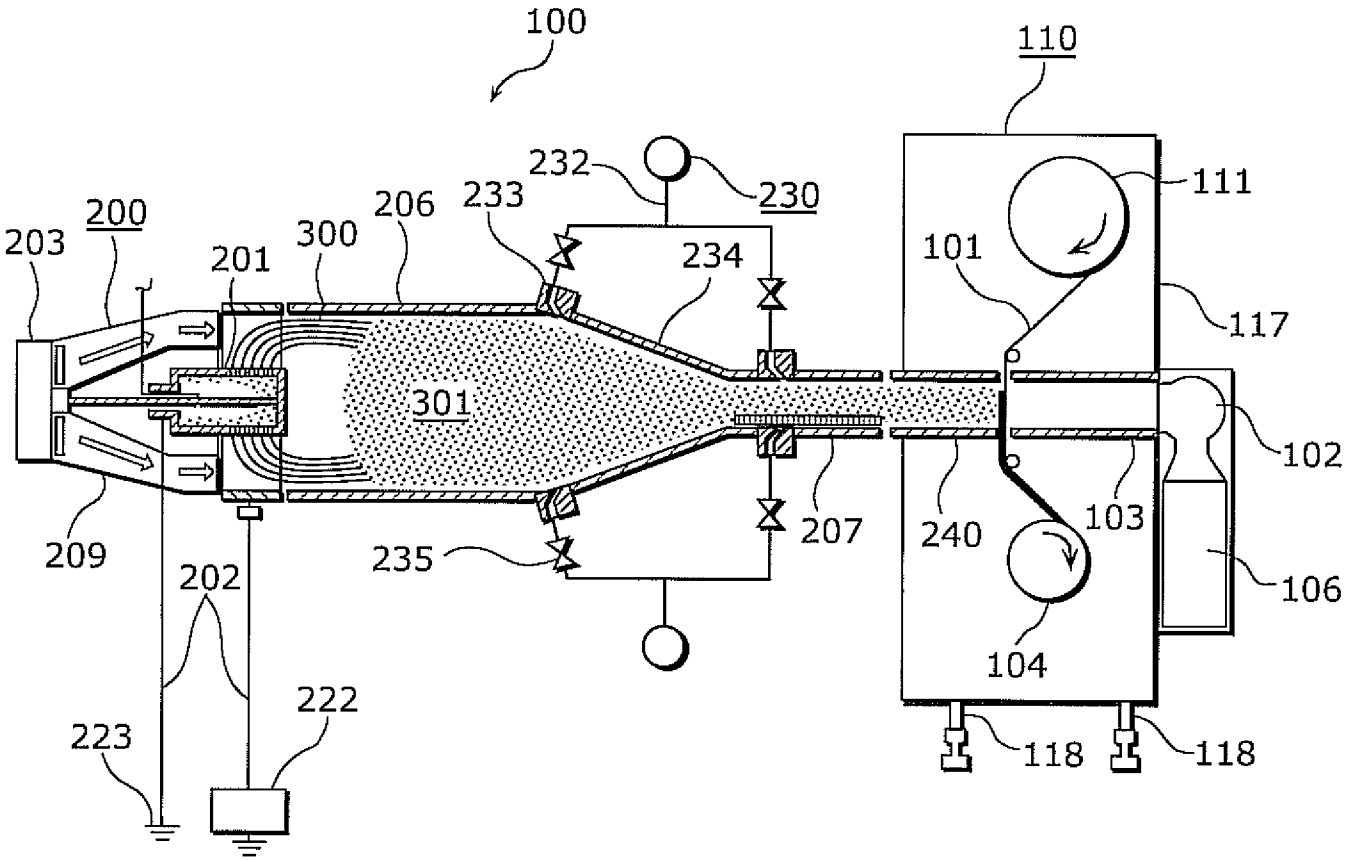
FIG. 10 is a cross-section diagram schematically showing a state where a discharging apparatus and a second collecting apparatus are mounted.
Figure 11:
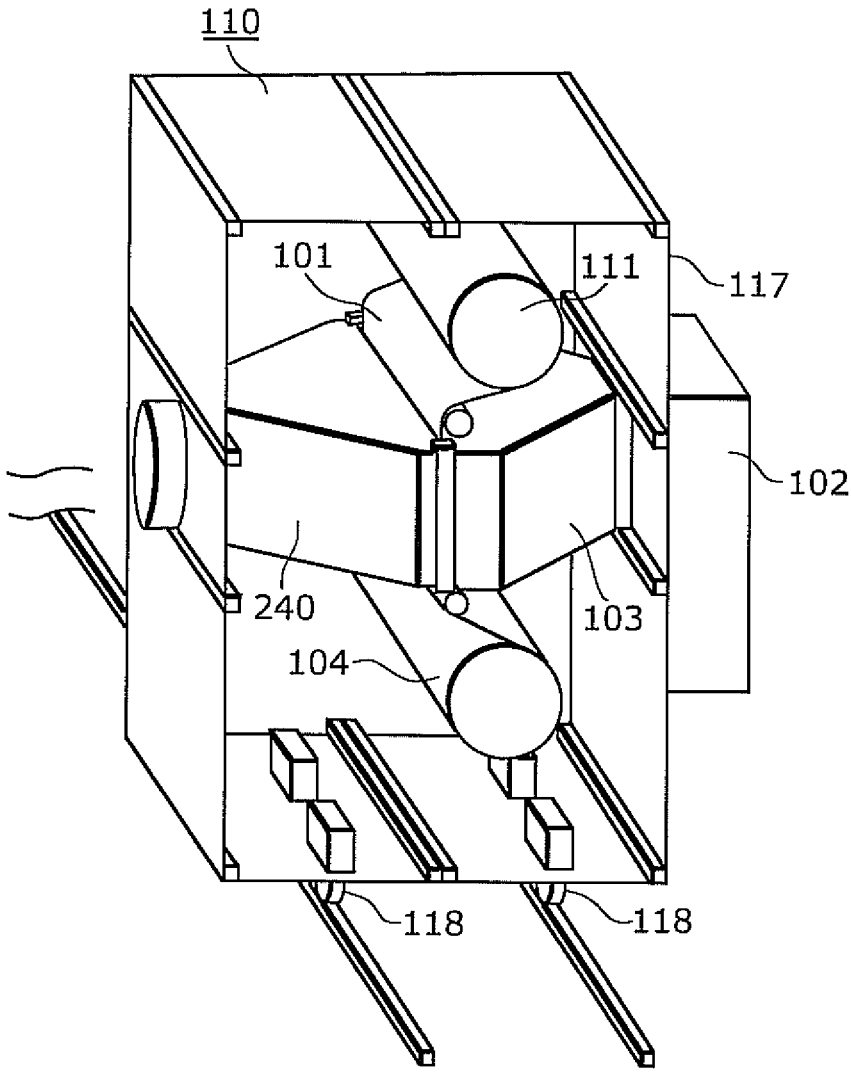
FIG. 11 is a perspective diagram of a second collecting apparatus with some parts of a body omitted.

As shown in FIGS. 10 and 11, the second collecting apparatus 110 includes the deposition member 101, the supplying unit 111, the transporting unit 104, a drawing unit 102 serving as an attracting apparatus, and the body 117.

The deposition member 101 is a member on which the traveling nanofibers 301 manufactured by electrostatic stretching phenomenon are deposited. The deposition member 101 is an elongated sheet-like member which is thin and flexible, and made of materials easily separable from the deposited nanofibers 301. More specifically, an example of the deposition member 101 is an elongated cloth made of aramid fiber. Further, Teflon (registered trademark) coating on the surface of the deposition member 101 is preferable since it enhances removability when removing the deposited nanofibers 301 from the deposition member 101.

Further, the deposition member 101 includes a plurality of air holes (not shown) to ensure proper air permeability of the gas flow generated by the gas flow generating unit 203, and is a mesh form filter on which the nanofibers 301 are deposited and through which the gas flow passes.

The supplying unit 111 is an apparatus which can sequentially supply the deposition member 101 wound around a winding member, and is provided with a tensioner so that the deposition member 101 can be supplied in a predetermined tension.

The transporting unit 104 winds the elongated deposition member 101 and simultaneously unwinds the deposition member 101 from the supplying unit 111, and collects the deposition member 101 together with the deposited nanofibers 301. The transporting unit 104 can wind the nanofibers 301 deposited in a non-woven fabric like state, together with the deposition member 101.

The drawing unit 102 is an apparatus which forcibly draws gas flow which passes through the deposition member 101, together with the solvent evaporated from the solution 300. In the present embodiment, a blower, such as a sirocco fan or an axial flow fan, is used as the drawing unit 102. Further, the drawing unit 102 is capable of drawing most of the gas flow in which solvent evaporated from the solution 300 is mixed, and transporting the gas flow to a solvent collecting apparatus 106 connected to the drawing unit 102.

At a position closer to the deposition member 101, the area regulating unit 103 has an opening having a shape and an area identical to those of the lead-out opening of the diffusing unit 240. The opening of the area regulating unit 103 at the side connected to the drawing unit 102 has a circular shape corresponding to the drawing unit 102. With this, the nanofibers 301 diffused by the diffusing unit 240 are entirely attracted onto the deposition member 101, and simultaneously all the gas flow are drawn.

The body 117 is a member to which the deposition member 101, the supplying unit 111, the transporting unit 104, and the drawing unit 102 are integrally mounted.

Further, the diffusing unit 240 is mounted inside the body 117. The wheels 118 are provided at the bottom of the body 117.

The diffusing unit 240 is a duct which widely diffuses and disperses the nanofibers 301 which have become a high density state by being compressed by the compressing unit 230. The diffusing unit 240 is a hood shaped member which decelerates the nanofibers 301 accelerated by the corn pressing unit 230. The diffusing unit 240 has an opening at the upstream end to which the gas flow is introduced, and a rectangular opening at the downstream end through which the gas flow is discharged. The area of the opening at the downstream end is greater than the area of the opening at the upstream end. The diffusing unit 240 has a shape having an area which gradually increases from the opening at the upstream end toward the opening at the downstream end. The opening at the downstream end has a width approximately same as that of the deposition member 101.

By the gas flow moving from the small-area lead-in end of the diffusing unit 240 toward the large-area lead-out end, the nanofibers 301 which are in a high density state become a low density state rapidly and are dispersed. At the same time, the velocity of the gas flow decreases in proportion to the cross-section area of the diffusing unit 240. Therefore, the traveling speed of the nanofibers 301 which are transported by the gas flow also decreases together with the decrease in the flow velocity of the gas flow. Here, the nanofibers 301 are gradually diffused evenly according to the increase in the cross section area of the diffusing unit 240. Accordingly, it is possible to evenly deposit the nanofibers 301 on the deposition member 101. Further, the drawing unit 102 draws the nanofibers 301 together with solvent; and thus, the nanofibers 301 are stably deposited on the deposition member 101.

The wheels 118 are provided for enabling the second collecting apparatus 110 to move, and are pivotally mounted at the bottom of the body 117. In the present embodiment, the wheels 118 rotate on rails.

In the second collecting apparatus 110, the nanofibers 301 are attracted onto the deposition member 101 by the drawing unit 102; and thus, in particular, the nanofibers 301 which have less charges can be stably deposited on the deposition member 101.

Next, a method for manufacturing nanofibers 301 using the nanofiber manufacturing apparatus 100 thus configured is described with reference to FIG. 6 to FIG. 11.

First, a first kind of nanofibers is manufactured.

The gas flow generating unit 203 and the second gas flow generating unit 232 generate gas flow inside the guiding unit 206 and the air channel 209.

Next, the solution 300 is supplied into the effusing body 211 of the effusing unit 201. The solution 300 is stored in a separate tank (not shown), and is supplied into the effusing body 211 from other end of the effusing body 211 via the supply path 217 (see FIG. 7).

Here, examples of resin constituting the nanofibers 301 include polypropylene, polyethylene, polystyrene, polyethylene oxide, polyethylene terephthalate, polybutylene terephthalate, polyethylene naphthalate, poly-m-phenylene terephthalate, poly-p-phenylene isophthalate, polyvinylidene fluoride, polyvinylidene fluoride-hexafluoropropylene copolymer, polyvinyl chloride, polyvinylidene chloride-acrylate copolymer, polyacrylonitrile, polyacrylonitrile-methacrylate copolymer, polycarbonate, polyarylate, polyester carbonate, nylon, aramid, polycaprolactone, polylactic acid, polyglycolic acid, collagen, polyhydroxybutyric acid, polyvinyl acetate, and polypeptide. Further, one type selected from the above may be used, or various types may be mixed. Note that these are just examples, and the present invention should not be limited to the above resins.

Examples of solvents used for the solution 300 include methanol, ethanol, 1-propanol, 2-propanol, hexafluoroisopropanol, tetraethylene glycol, triethylene glycol, dibenzyl alcohol, 1,3-dioxolane, 1,4-dioxane, methyl ethyl ketone, methyl isobutyl ketone, methyl-n-hexyl ketone, methyl-n-propyl ketone, diisopropyl ketone, diisobutyl ketone, acetone, hexafluoroacetone, phenol, formic acid, methyl formate, ethyl formate, propyl formate, methyl benzoate, ethyl benzoate, propyl benzoate, methyl acetate, ethyl acetate, propyl acetate, dimethyl phthalate, diethyl phthalate, dipropyl phthalate, methyl chloride, ethyl chloride, methylene chloride, chloroform, o-chlorotoluene, p-chlorotoluene, chloroform, carbon tetrachloride, 1,1-dichloroethane, 1,2-dichloroethane, trichloroethane, dichloropropane, dibromoethane, dibromopropane, methyl bromide, ethyl bromide, propyl bromide, acetic acid, benzene, toluene, hexane, cyclohexane, cyclohexanone, cyclopentane, o-xylene, p-xylene, m-xylene, acetonitrile, tetrahydrofuran, N,N-dimethylformamide, pyridine, and water. Further, one type selected from the above may be used, or various types may be mixed. Note that these are just examples, and the present invention should not be limited to the above solvents.

In addition, some additive agent such as aggregate or plasticizing agent may be added to the solution 300. Examples of additive agent include oxides, carbides, nitrides, borides, silicides, fluorides, and sulfides. However, in view of thermal resistance, workability, and the like, oxides are preferable. Examples of oxides include $Al_2O_3$, $SiO_2$, $TiO_2$, $Li_2O$, $Na_2O$, MgO, CaO, SrO, BaO, $B_2O_3$, $P_2O_5$, $SnO_2$, $ZrO_2$, $K_2O$, $Cs_2O$, ZnO, $Sb_2O_3$, $As_2O_3$, $CeO_2$, $V_2O_5$, $Cr_2O_3$, MnO, $Fe_2O_3$, CoO, NiO, $Y_2O_3$, $Lu_2O_3$, $Yb_2O_3$, $HfO_2$, and $Nb_2O_5$. Further, one type selected from the above may be used, or various types may be mixed. Note that these are just examples, and the present invention should not be limited to the above additive agents.

Desirable mixing ratio of solvent and resin is that the resin constituting the nanofiber is selected in the range of not less than 1 vol % and not more than 50 vol %, and the corresponding solvent is selected in the range of not less than 50 vol % and not more than 99 vol %.

As described, even if the solution 300 includes the solvent of 50 vol % or more as above, the solvent evaporates sufficiently because solvent vapor does not stay due to the gas flow. This allows the electrostatic stretching phenomenon to occur. Accordingly, the nanofibers 301 are manufactured from the state where resin that is the solvent is thin, thinner nanofibers 301 can also be manufactured. Further, the adjustable range of the solution 300 increases, allowing wider range of performances of the manufactured nanofibers 301.

Next, while an electric charge is applied to the solution 300 stored in the effusing body 211 by the charging power source 222 (charging process), the effusing body 211 is rotated by the motor 213, so that the charged solution 300 is effused through the effusion holes 216 by the centrifugal force (effusing process).

The traveling direction of the solution 300 effused radially in a radial direction of the effusing body 211 is changed by the gas flow, and the solution 300 is guided by the gas flow through the air channel 209. While the solution 300 is manufactured into the nanofibers 301 by the electrostatic stretching phenomenon (nanofiber manufacturing process), the solution 300 is discharged to the guiding unit 206. Further, the gas flow, which is heated by the heating unit 205, guides the traveling of the solution 300 and facilitates the evaporation of the solvent by applying heat to the solution 300. In such a manner, the nanofibers 301 are transported inside the guiding unit 206 by the gas flow (transporting process).

Following this, the nanofibers 301, which passes through the compressing unit 230, are accelerated by the jet flow of the high pressure gas, and are gradually compressed as the inside of the compressing unit 230 becomes narrower. Then, the nanofibers 301 become a high density state and reaches the diffusing unit 240 (compressing process).

Here, the nanofibers 301 which have been transported by the gas flow may have less electric charges; and thus, the second charging unit 207 forcibly charges the nanofibers 301 with the same polarity (second charging process).

The nanofibers 301 transported to the diffusing unit 240 reduces its traveling speed rapidly, and are evenly dispersed (diffusing process).

In such a state, the attracting electrode 112 placed at the opening portion of the diffusing unit 240 attracts the nanofibers 301 because the attracting electrode 112 is charged to a polarity opposite to the charge polarity of the nanofibers 301 (attracting process). Since the deposition member 101 is placed between the nanofibers 301 and the attracting electrode 112, the nanofibers 301 attracted to the attracting electrode 112 are deposited on the deposition member 101 (depositing process).

Here, when the amount of the first kind of nanofibers which have been manufactured reaches a predetermined amount, changeover is performed to manufacture a second kind of nanofibers.

For changeover, after the operations of the discharging apparatus 200 is stopped, the discharging apparatus 200 and the collecting apparatus 110 is disconnected, and the collecting apparatus 110 is moved along the rails. Then, another collecting apparatus 110 prepared in advance is moved along the rails to connect to the discharging apparatus 200. After that, the discharging apparatus 200 is again started to operate to manufacture the second kind of nanofibers.

While the second kind of nanofibers are manufactured, all of the deposition member 101 of the first collecting apparatus 110 is collected, and then a new deposition member 101 is mounted to the first collecting apparatus 110 for the manufacturing of the next kind of nanofibers.

With the configuration thus described, it is possible to separate the discharging apparatus 200 and the collecting apparatus 110. More specifically, the solution 300 is charged by an electric charge applied by the first charging unit 202 included in the discharging apparatus 200; and thus, the solution 300 is not influenced by the collecting apparatus 110. Therefore, even if the collecting apparatus 110 is replaced, the manufacturing of the nanofibers 301 can be continued without problems. It further allows selection of the types of the collecting apparatus for one discharge apparatus 200, such as the collection apparatus which utilizes the gas flow or electric field.

Therefore, as described above, changeover can be performed in a short period of time, and the manufacturing efficiency of the nanofiber manufacturing apparatus 100 can be improved.

The collection apparatus 110 used after the changeover may be the first collecting apparatus 110 which performs attraction using an electric field or the second collecting apparatus 110 which performs attraction using the gas flow.

Further, the number of the collecting apparatus 110 included in the nanofiber manufacturing apparatus 100 is not limited to two, but, for example, plural first apparatus 110 and plural second collecting apparatus 110 may be included.

In the present embodiment, the case has been described where both of the first collecting apparatus and the second collecting apparatus can be used; however, only the collecting apparatus which performs attraction using an electric field, or only the collecting apparatus which performs attraction using the gas flow may be used.

Further, in the present embodiment, it has been described that the collecting apparatus includes the diffusing unit 240, but the present invention is not limited to this. For example, the diffusing unit 240 may be incorporated to the discharging apparatus 200 so that the diffusing unit 240 and the collecting apparatus 110 can be separated.

Embodiment 3

Next, Embodiment 3 of a nanofiber manufacturing apparatus according to the present invention is described with reference to the drawings.

Figure 12:
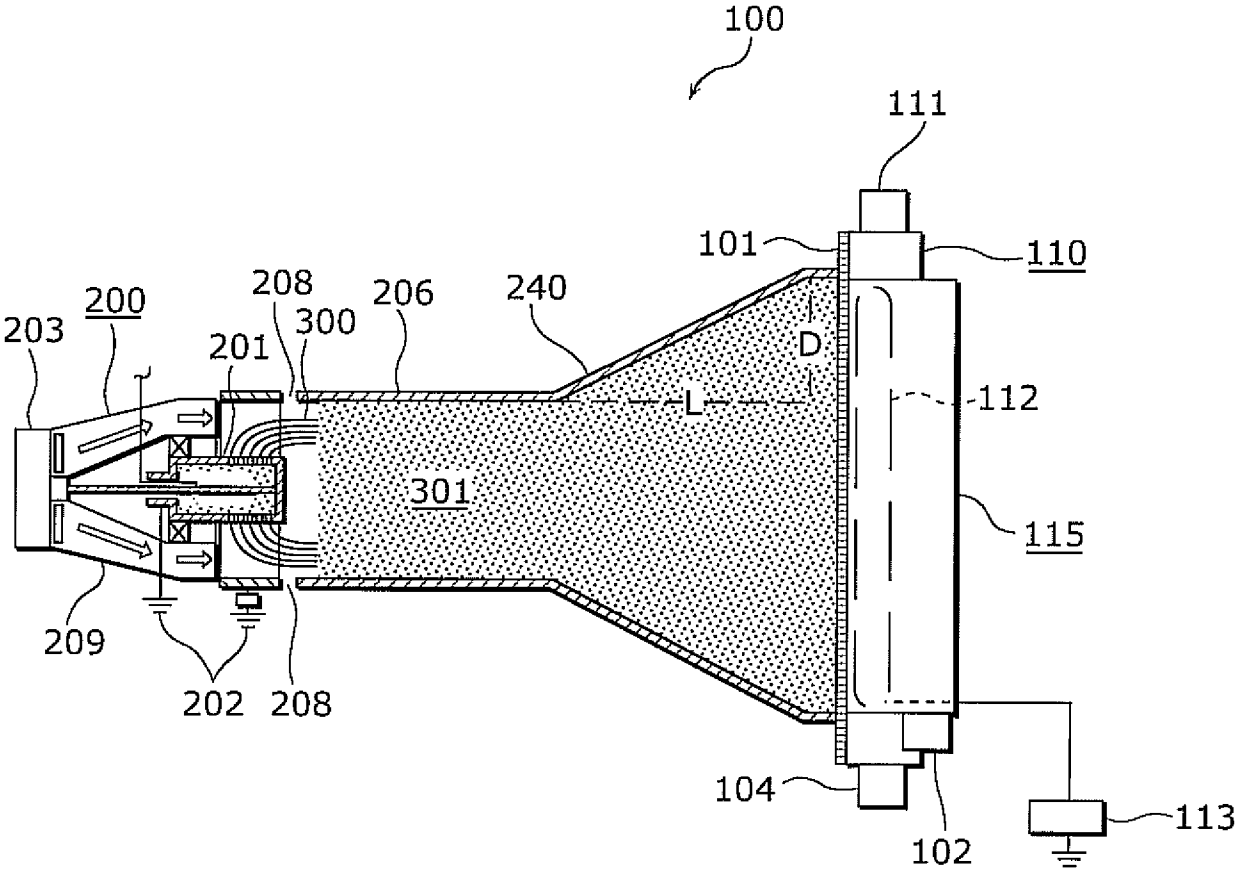
FIG. 12 is a cross-section diagram schematically showing a nanofiber manufacturing apparatus according to one embodiment of the present invention.

FIG. 12 is a cross-section diagram schematically showing a nanofiber manufacturing apparatus according to Embodiment 3 of the present invention.

Figure 13:
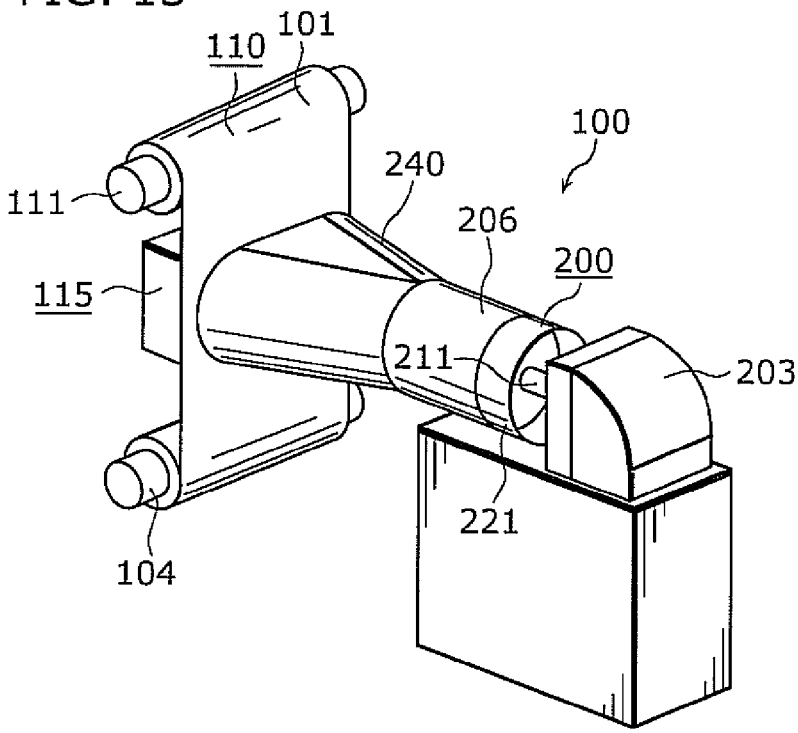
FIG. 13 is a perspective diagram schematically showing the nanofiber manufacturing apparatus according to one embodiment of the present invention.

FIG. 13 is a perspective diagram schematically showing the nanofiber manufacturing apparatus according to Embodiment 3 of the present invention.

As shown in FIGS. 12 and 13, a nanofiber manufacturing apparatus 100 includes a discharging apparatus 200, a guiding unit 206, a diffusing unit 240, a collecting apparatus 110, and an attracting apparatus 115.

Figure 14:
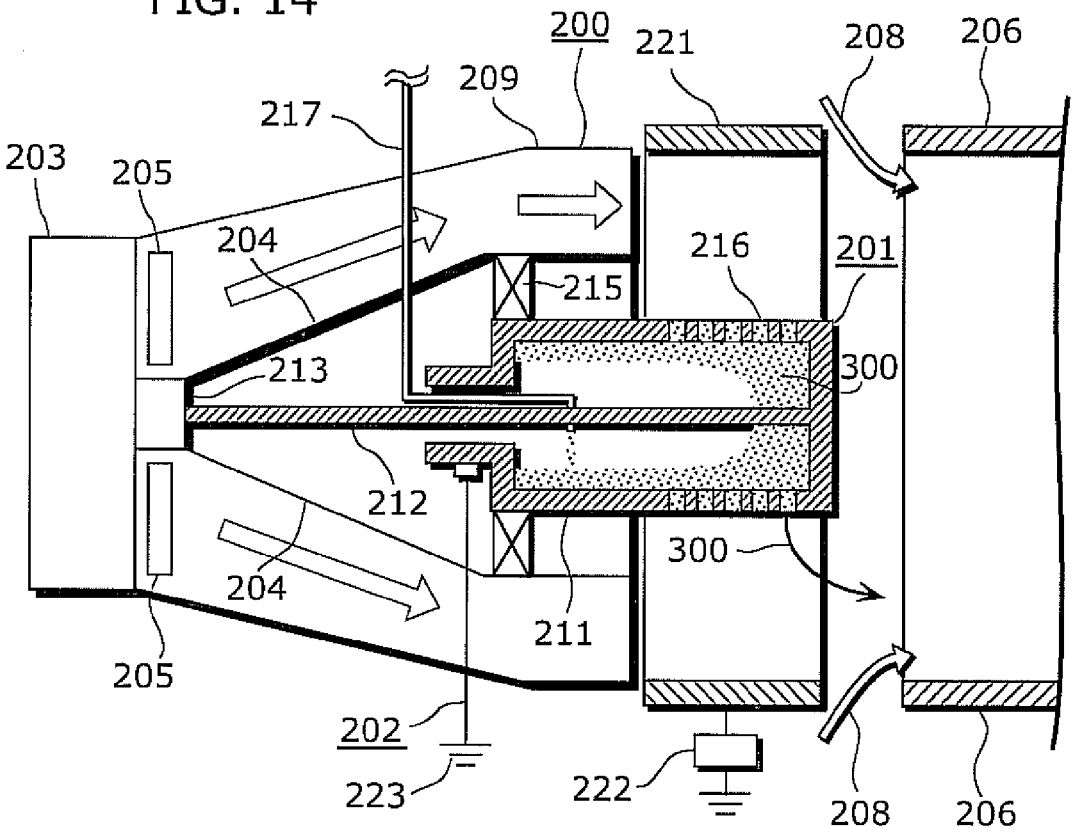
FIG. 14 is a cross-section diagram showing a discharging apparatus.

FIG. 14 is a cross-section diagram of the discharging apparatus.

Figure 15:
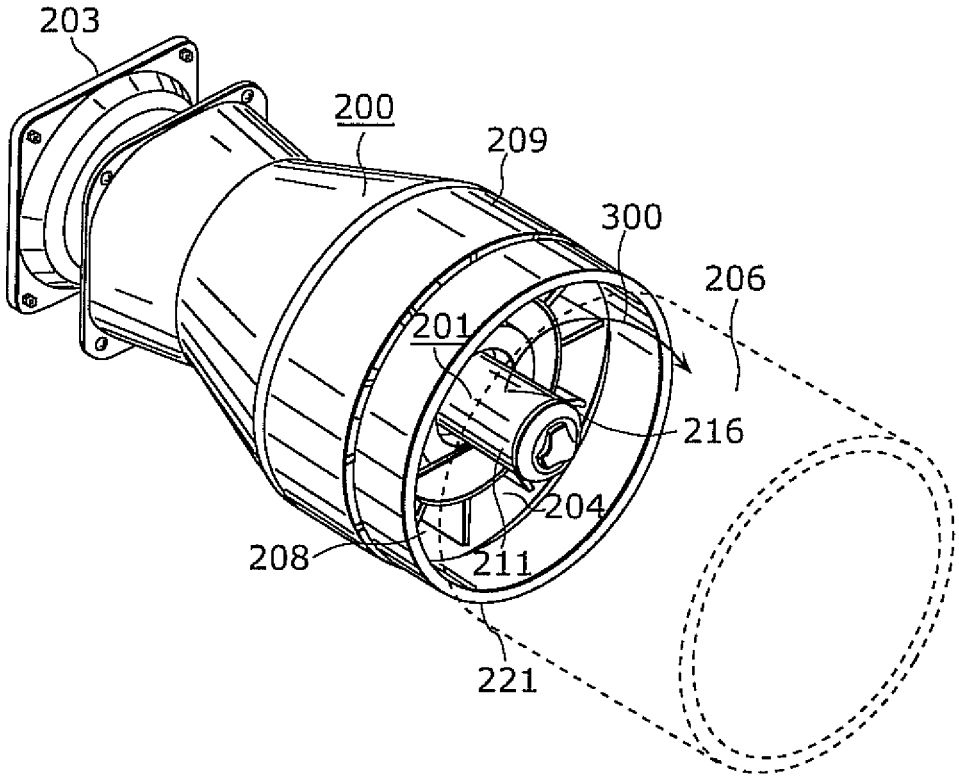
FIG. 15 is a perspective diagram showing the discharging apparatus.

FIG. 15 is a perspective diagram of the discharging apparatus.

The discharging apparatus 200 is a unit capable of discharging, by gas flow, charged solution 300 or nanofibers 301 being manufactured, and includes an effusing unit 201, a charging unit 202, air channel 209, and a gas flow generating unit 203.

As shown in these figures, the effusing unit 201 is an apparatus which effuses the solution 300 into the space. In the present embodiment, the effusing unit 201 is an apparatus which radially effuses the solution 300 by the centrifugal force and effuses the solution 300 inside the charging electrode 221. The effusing unit 201 includes an effusing body 211, a rotary shaft 212, and a motor 213.

The effusing body 211 is a member which has effusion holes 216 which effuses the solution 300 into the space. In the present embodiment, the effusing body 211 is a container which can effuse the solution 300 into the space by the centrifugal force caused by rotation of the effusing body 211 while the solution 300 being supplied inside. The effusing body 211 has a cylindrical shape whose one end is closed, and includes a plurality of effusion holes 216 on its circumferential wall. The effusing body 211 is formed of a conductive material so that an electric charge can be applied to the solution 300 contained inside. The effusing body 211 is pivotally supported by a bearing 215 provided to a support (not shown).

More particularly, it is preferable that the diameter of the effusing body 211 is set within a range of not less than 10 mm to not more than 300 mm. It is because, if the diameter is too large, causing the gas flow (to be described later) to concentrate the solution 300 or the nanofibers 301 is unlikely. It is also because, if the weight balance is unbalanced even slightly, such as the case of the rotary shaft of the effusing body 211 is decentered, significant vibration is caused, and a structure to support the effusing body 211 firmly is required to suppress such vibration. On the other hand, if the diameter is too small, it is necessary to increase the number of rotations of the effusing body 211 so that the solution 300 is effused by the centrifugal force. This causes problems associated with, for example, extra loads or vibrations of the motor. Further, it is preferable that the diameter of the effusing body 211 is set within a range of not less than 20 mm to not more than 100 mm.

Further, it is preferable that the shape of the effusion hole 216 is circular. The preferable diameter of the effusion hole 216 depends on the thickness of the effusing body 211, but it is preferable to set within a range of not less than 0.01 mm to not more than 3 mm. This is because, if the effusion holes are too small, effusing the solution 300 outside the effusing body 211 is unlikely, and if the effusion holes are too large, the amount of the solution 300 effused from each effusion hole 216 per unit time is too much (that is, the thickness of the filament formed by the effused solution 300 is too large) and the nanofibers 301 with desired diameter are difficult to manufacture.

The shape of the effusing body 211 is not limited to the cylindrical shape, but may be a polygonal column shape having a polygonal cross section, a conic shape, or the like. Further, the shape of the effusion holes 216 is not limited to circular, but may be polygonal, star like shape, or the like.

The rotary shaft 212 is a shaft which transmits a drive force for rotating the effusing body 211 so as to effuse the solution 300 by the centrifugal force. The rotary shaft 212 has a rod shape and is inserted into the effusing body 211 from other end of the effusing body 211. One end of the rotary shaft 212 is connected with the closed end of the effusing body 211. Further, the other end of the rotary shaft 212 is connected to the rotary shaft of the motor 213.

The motor 213 is an apparatus which applies rotation drive force to the effusing body 211 via the rotary shaft 212 for effusing the solution 300 through the effusion holes 216 by the centrifugal force. It is preferable that the number of rotation of the effusing body 211 is set within a range of not less than a few rpm to not more than 10000 rpm depending on, for example, the bore of the effusion holes 216, viscosity of the solution 300, or types of resin in the solution. When the effusing body 211 is directly driven by the motor 213 as in the present embodiment, the number of rotation of the motor 213 corresponds to the number of rotation of the effusing body 211.

The charging unit 202 is an apparatus which electrically charges the solution 300 by applying an electric charge to the solution 300. In the present embodiment, the charging unit 202 includes a charging electrode 221, a charging power source 222, and a grounding unit 223. Further, the effusing body 211 also serves as part of the charging unit 202.

The charging electrode 221 is a member for inducing charges on the effusing body 211, which is provided near the charging electrode 221 and is grounded, by having a voltage higher or lower than ground. In the present embodiment, the charging electrode 221 is an annular member provided so as to surround the tip of the effusing body 211. When a positive voltage is applied to the charging electrode 221, a negative charge is induced to the effusing body 211, and when a negative charge is applied to the charging electrode 221, a positive charge is induced to the effusing body 211. Further, the charging electrode 221 also serves as the air channel 209 which guides the gas flow generated from the gas flow generating unit 203 to the guiding unit 206.

The charging electrode 221 needs to be larger than the diameter of the effusing body 211. It is preferable that the diameter of the charging electrode 221 is set in the range from not less than 200 mm to not more than 800 mm.

The charging power source 222 is a power source which can apply a high voltage to the charging electrode 221. It is preferable that, in general, the charging power source 222 is a DC power source. In particular, a DC power source is preferable, for example, in the case where the nanofiber manufacturing apparatus 100 is not influenced by the charge polarity of the nanofibers 301 to be manufactured, or in the case where the manufactured nanofibers 301 are collected on the electrode using the electric charge of the nanofibers 301. Further, in the case where the charging power source 222 is a DC power source, it is preferable to set a voltage to be applied by the charging power source 222 to the charging electrode 221 within the range from not less than 10 KV to not more than 200 KV. When a negative voltage is applied to the charging power source 222, the voltage applied by the charging power source 222 to the charging electrode 221 has a negative polarity.

The grounding unit 223 is an apparatus which is electrically connected to the effusing body 211 and maintains the effusing body 211 at a ground potential level. One end of the grounding unit 223 serves as a brush so that electric connection state can be maintained even when the effusing body 211 is in a rotating state. The other end is connected to the ground.

Note that the electric field strength between the effusing body 211 and the charging electrode is important; and thus, it is preferable to set a voltage to be applied or shape of the charging electrode 221, or to place the effusing body 211 and the charging electrode 221 such that the electric field strength is 1 KV/cm or more. The shape of the charging electrode 221 is not limited to an annular shape, but may be a polygonal shaped annular member having a polygonal cross-section.

As in the present embodiment, if an induction method is used in the charging unit 202, it is possible to apply an electric charge to the solution 300 while the effusing body 211 is maintained at the ground potential level. When the effusing body 211 is in the ground potential level, there is no need to electrically isolate, from the effusing body 211, members such as the rotary shaft 212 or the motor 213 that are connected to the effusing body 211. This is preferable since it allows a simple structure of the effusing unit 201.

It may be that a power source is connected to the effusing body 211, the effusing body 211 is maintained at a high voltage, and the charging electrode 221 is grounded, so as to serve as the first charging unit 202 and to apply an electric charge to the solution 300. Further, it may be that the effusing body 211 is formed of an insulating material, an electrode which directly contacts the solution 300 stored in the effusing body 211 is provided inside the effusing body 211, and an electric charge is applied to the solution 300 using the electrode. In the case where an electrode is directly provided to the effusing body 211 or provided so as to directly contact the solution, the charge polarity of the solution is the same as the polarity of the voltage applied.

The gas flow generating unit 203 is an apparatus which generates gas flow for changing the traveling direction of the solution 300 effused from the effusing body 211 into the direction guided by the guiding unit 206. The gas flow generating unit 203 is provided at the rear side of the motor 213, and generates gas flow directed to the tip of the effusing body 211 from the motor 213. The gas flow generating unit 203 is capable of generating force which changes, into the axial direction of the effusing body 211, the direction of the solution 300 radially effused from the effusing body 211 before the solution 300 reaches the charging electrode 221. In FIG. 14, the gas flow is indicated by largest arrows. In the present embodiment, a blower including an axial flow fan which forcibly blows atmosphere around the discharging apparatus 200 is used as the gas flow generating unit 203.

The gas flow generating unit 203 may be made of other types of blowers, such as a sirocco fan. Further, the gas flow generating unit 203 may change the direction of the effused solution 300 by introducing high pressure gas. In addition, the gas flow generating unit 203 may generate gas flow inside the guiding unit 206 by the drawing unit 102 or the like. In this case, the gas flow generating unit 203 does not include an apparatus for actively generating gas flow; however, in the embodiments according to the present invention and any other conceivable embodiments, it is considered that the gas flow generating unit 203 is present since gas flow is generated inside the air channel 209. In addition, the gas flow generating unit 203 is considered to be present also in the case where the gas flow is generated inside the air channel 209 or the guiding unit 206 through the drawing performed by the drawing unit 102 without having the gas flow generating unit 203. In addition, it is considered that the drawing unit 102 serves as the gas flow generating unit in the case where the gas flow is generated inside the air channel 209 or the guiding unit 206 by the drawing performed by the drawing unit 102 included in the attracting apparatus 115.

The air channel 209 are ducts for guiding gas flow generated by the gas flow generating unit 203 to an area close to the effusing body 211. The gas flow guided by the air channel 209 intersects with the solution 300 effused from the effusing body 211, thereby changing the travel direction of the solution 300.

The discharging apparatus 200 further includes a gas flow controlling unit 204 and a heating unit 205.

The gas flow controlling unit 204 has a function to control the gas flow generated by the gas flow generating unit 203 such that the gas flow does not hit the effusion holes 216. In the present embodiment, a funnel shaped member, which guides the gas flow to travel to a specific area, is used as the gas flow controlling unit 204. The gas flow controlling unit 204 prevents the gas flow from directly hitting the effusion holes 216; and thus, it is possible to prevent, as much as possible, the solution 300 effused from the effusion holes 216 from evaporating early and blocking the effusion holes 216. As a result, the solution 300 can be stably and continuously effused. Note that the gas flow controlling unit 204 may be a windshield wall which is provided upstream of the effusion holes 216 and prevents the gas flow from reaching near the effusion holes 216.

The heating unit 205 is a heating source which heats gas forming the gas flow generated by the gas flow generating unit 203. In the present embodiment, the heating unit 205 is an annular heater provided inside the guiding unit 206, and is capable of heating gas which passes through the heating unit 205. By heating the gas flow using the heating unit 205, evaporation of the solution 300 effused into the space is facilitated, thereby effectively manufacturing the nanofibers.

A guiding unit 206 is a member constituting an air channel which guides the nanofibers 301 discharged from the discharging apparatus 200 to a predetermined area. The guiding unit 206 has an opening shape same as the opening shape of the discharging apparatus 200 at the side where the nanofibers 301 are discharged, and is placed, and is placed in a continuous manner with a predetermined spacing. The spacing between the discharging apparatus 200 and the guiding unit 206 forms an inlet 208.

The inlet 208 is an opening for introducing the atmosphere outside the guiding unit 206 into inside the guiding unit 206. In the present embodiment, the inlet 208 is provided between the discharging apparatus 200 and the guiding unit 206, and opened evenly along the whole circumference of the guiding unit 206. The curved arrows indicated at the inlet 208 in FIG. 14 schematically shows the atmosphere introduced inside the guiding unit 206.

Now, descriptions are continued with reference to FIGS. 12 and 13.

The diffusing unit 240 is an air channel which is connected to the guiding unit 206, and which widely diffuses and disperses the nanofibers 301, together with the gas flow, which are guided through the inside of the guiding unit 206. The diffusing unit 240 is a member which decelerates the nanofibers 301 transported by the gas flow. The diffusing unit 240 has a shape in which an opening area (the area indicated by C in FIG. 16) having a cross section perpendicular to the transporting direction of the nanofibers 301 continuously increases in the transporting direction. The opening shape of the cross section of the diffusing unit 240 (C in FIG. 16) is smooth and closed in any cross section. Here, smooth refers to the case where there is no corner at the intersection of two straight lines. Further, it may also be considered that smooth refers to the case where derivative is always present at any point on the opening shape of the cross section.

In the present embodiment, the shape of the opening of the diffusing unit 240 at the upstream end where the gas flow is introduced is circular, and the shape of the opening at the downstream end is ellipse (racetrack geometry). The opening at the upstream end and the opening at the downstream end are connected by a straight line. More specifically, the opening shape of the cross section of the diffusing unit 240 is smooth at any point, and is a convex shape. Further, three-dimensional shape surrounded by the diffusing unit 240 has also a convex shape. Here, ellipse (racetrack geometry) refers to a shape formed by dividing a true circle into two by its diameter to obtain a first semicircle and a second semicircle, and connecting respective edges by straight lines with the chord of each semicircle facing each other. It is the shape of a racetrack used for athletic sports. Further, the convex shape refers to a shape where a line connecting any two points in a closed shape is always present in the closed shape.

Figure 16:
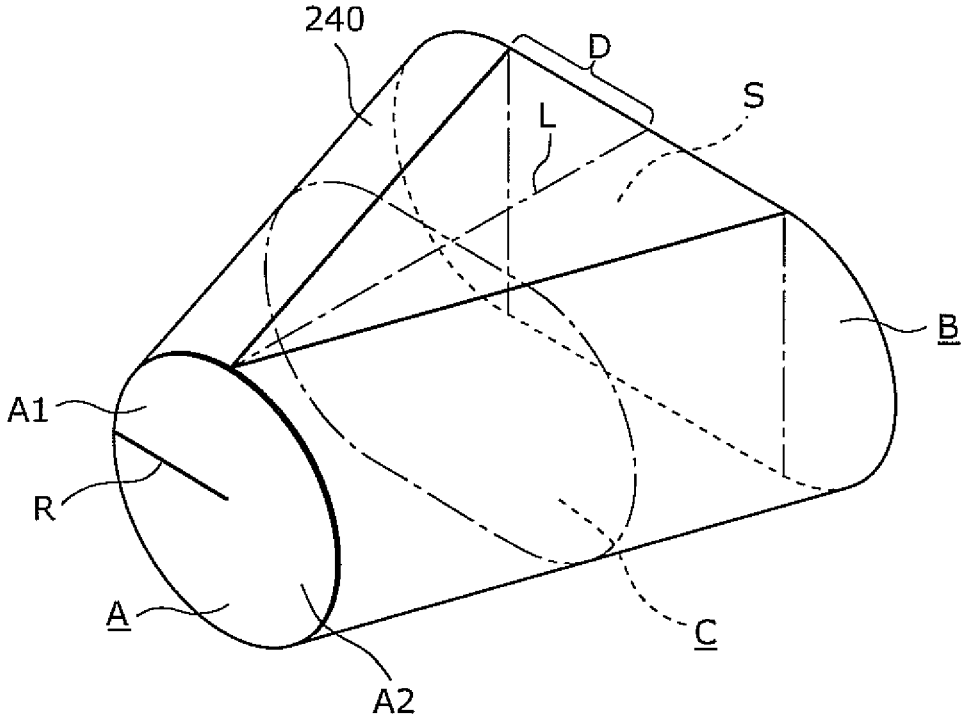
FIG. 16 is a perspective diagram schematically showing a diffusing unit.

As shown in FIG. 16, the diffusing unit 240 according to the present embodiment has an opening shape A at the upstream end that is a true circle having a radius R. The opening shape B at the downstream end of the diffusing unit 240 is an ellipse shape formed by dividing the opening shape A at the upstream end by its diameter into two semicircles, that is, a first semicircle A1 and a second semicircle A2, and by connecting the two by straight lines. The diffusing unit 240 has a shape where the distance between the first semicircle A1 and the second semicircle A2 linearly increases as the transporting direction of the nanofibers 301 goes further. Further, it is preferable that the diffusing unit 240 has, relative to the transporting direction of the nanofibers, a declination D/L (where L is a distance in the transporting direction and D is a distance perpendicular to the transporting direction) of ¼ or more and ½ or less. This is because, in the case where D/L is less than ¼, the transporting distance of the nanofibers 301 needs to be long to distribute the nanofibers 301 into a desired extent. This makes it difficult to ensure uniform distribution of the nanofibers 301. On the other hand, in the case where D/L is greater than ½, the nanofibers 301 are dispersed rapidly. This also makes it difficult to ensure the uniform distribution of the nanofibers. In the present embodiment, D/L is ⅓.

Further, in the present embodiment, two inclinations where D/L is ⅓ are provided so as to oppose the diffusing unit 240. Thus, the diffusion ratio of the diffusing unit 240, that is, the increase rate S/L of the opening area of the cross section relative to the distance of the transporting direction is 2R/3. Therefore, the diffusing unit 240 can transport the nanofibers 301 together with the gas flow while dispersing in the diffusion ratio of 2R/3.

It is considered that the diffusing unit 240 provides the advantageous effects as described below. When the gas flow moves from the upstream end toward the downstream end of the diffusing unit 240, the nanofibers 301 that are in a high density state gradually becomes low density state and are dispersed. At the same time, the velocity of the gas flow decreases in proportion to the opening area of the cross section of the diffusing unit 240. Therefore, the traveling speed of the nanofibers 301 which are transported by the gas flow also decreases together with the decrease in the flow velocity of the gas flow. Here, the nanofibers 301 are gradually diffused evenly according to the increase in the opening area of the cross section. Accordingly, it is possible to evenly deposit the nanofibers 301 on the deposition member 101. Furthermore, since the opening of the cross section of the diffusing unit 240 has a smooth and closed shape, and the shape of the opening of the cross section continuously and smoothly enlarges, the gas flow smoothly disperses, resulting in causing the nanofibers 301 to be evenly diffused.

Figure 17:
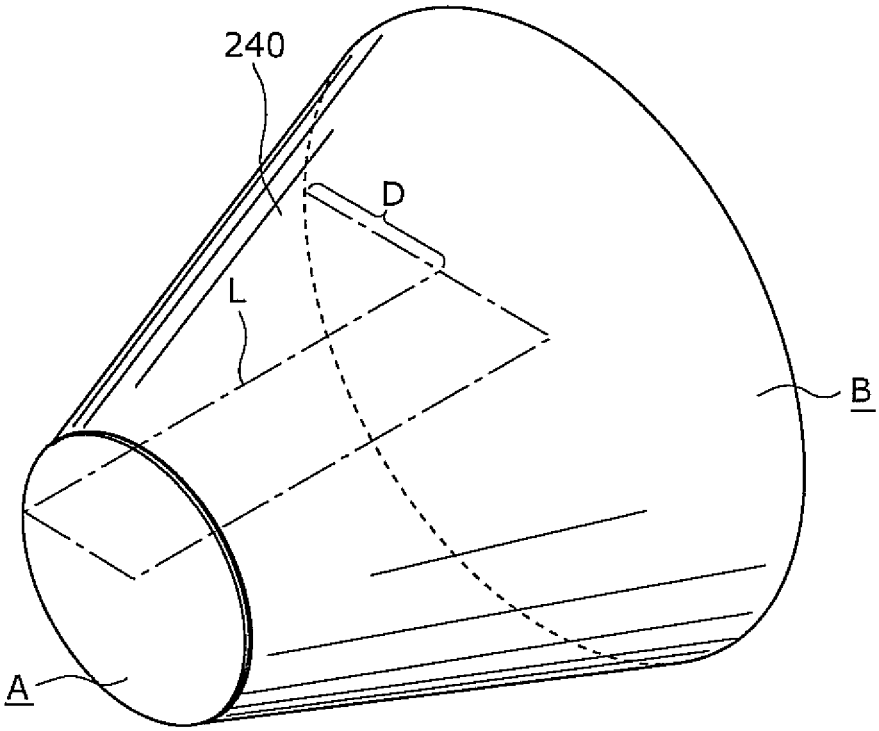
FIG. 17 is a perspective diagram schematically showing a diffusing unit according to another embodiment.

Further, in the present embodiment, an example has been described where the opening shape of the upstream end of the diffusing unit 240 one-dimensionally extends, but the present invention is not limited to this. For example, as shown in FIG. 17, it may be that the opening shape A at the upstream end gradually and two-dimensionally extends, and that the opening shape B at the downstream end is similar to the opening shape A. In this case, too, it is preferable that the diffusing unit 240 has a declination D/L, relative to the transporting direction of the nanofibers, of ¼ or more and ½ or less.

Further, the inner surface of the diffusing unit 240 may be coated with fluorine-based resin. This prevents the nanofibers 301 from adhering to the inner wall of the diffusing unit 240.

Now, descriptions are continued with reference to FIGS. 12 and 13.

The collecting apparatus 110 is an apparatus which collects the nanofibers 301 discharged by the diffusing unit 240, and includes a deposition member 101 and a transporting unit 104.

The deposition member 101 is a member on which the traveling nanofibers 301 manufactured by electrostatic stretching phenomenon are deposited. The deposition member 101 is an elongated sheet-like member which is thin and flexible, and made of materials easily separable from the deposited nanofibers 301. More specifically, an example of the deposition member 101 is an elongated cloth made of aramid fiber. Further, Teflon (registered trademark) coating on the surface of the deposition member 101 is preferable since it enhances removability when removing the deposited nanofibers 301 from the deposition member 101. Further, the deposition member 101 is supplied being wound into a roll from a supplying unit 111.

The transporting unit 104 winds the elongated deposition member 101 and simultaneously unwinds the deposition member 101 from the supplying unit 111, and transports the deposition member 101 together with the deposited nanofibers 301. The transporting unit 104 can wind the nanofibers 301 deposited in a non-woven fabric like state, together with the deposition member 101.

An attracting apparatus 115 is an apparatus which attracts the traveling nanofibers 301 onto the deposition member 101. Examples of the attracting apparatus 115 include an attracting apparatus which utilizes an electric field attracting method which attracts the charged nanofibers 301 by an electric field using an electrode applied with a potential opposite to that of the charged nanofibers 301 (or a ground potential) and a gas attracting method which attracts the nanofibers 301 together with the gas flow by drawing the gas flow.

In the present embodiment, the attracting apparatus 115 which includes both the electric field attracting method and the gas attracting method. The attracting apparatus 115 includes an attracting electrode 112, an attraction power source 113, and a drawing unit 102.

The attracting electrode 112 is a member which attracts the charged nanofibers 301 by an electric field, and is a rectangle plate-like electrode that is a size smaller than the size of the opening at the downstream end of the diffusing unit 240. The peripheral portion of the face of the attracting electrode 112 toward the diffusing unit 240 is not sharpened, and is totally rounded. This prevents anomalous electric discharge from occurring. Further, the attracting electrode 112 includes a plurality of permeable holes for allowing the gas flow drawn by the drawing unit 102 to pass through.

The attraction power source 113 is a power source for applying an electric potential to the attracting electrode 112. In the present embodiment, a DC power source is used.

The drawing unit 102 is an apparatus which draws, from the diffusing unit 240, the gas flow which passes through the deposition member 101 and the attracting electrode 112. In the present embodiment, for the drawing unit 102, a blower, such as a sirocco fan or an axial flow fan is used.

Next, a method for manufacturing nanofibers 301 using the nanofiber manufacturing apparatus 100 thus configured is described.

First, the gas flow generating unit 203 and the drawing unit 102 generate gas flow, which is directed from the gas flow generating unit 203 to the deposition member 101, inside the guiding unit 206 and the air channel 209. Due to the gas flow passing through the guiding unit 206, the inside of the guiding unit 206 has a pressure lower than outside of the guiding unit 206. Thus, atmosphere outside the guiding unit 206 (air in the case of the present embodiment) flows in through the inlet 208. It is a so-called Venturi effect.

Next, the solution 300 is supplied into the effusing body 211 of the effusing unit 201. The solution 300 is stored in a separate tank (not shown), and is supplied into the effusing body 211 from the other end of the effusing body 211 via the supply path 217 (see FIG. 14).

Next, while the charging power source 222 makes the charging electrode 221 to have a voltage higher than that of the effusing body 211 and applies an electric charge to the solution 300 stored in the effusing body 211 (charging process), the effusing body 211 is rotated by the motor 213, so that the charged solution 300 is effused through the effusion holes 216 by the centrifugal force (effusing process).

The traveling direction of the solution 300 effused radially in a radial direction of the effusing body 211 is changed by the gas flow, and the solution 300 is guided by the gas flow by the air channel 209 and the charging electrode 221. The nanofibers 301 are manufactured from the solution 300 through the electrostatic stretching phenomenon (nanofiber manufacturing process) and are discharged from the discharging apparatus 200. Further, the gas flow, which is heated by the heating unit 205, guides the traveling of the solution 300 and facilitates the evaporation of the solvent by applying heat to the solution 300.

The nanofibers 301 thus discharged from the discharging apparatus 200 is introduced to the guiding unit 206. Here, since air flows in through the inlet 208 provided at the end of the guiding unit 206, the nanofibers 301 are transported being pushed toward the axial direction of the guiding unit 206 (transporting process).

Therefore, the nanofibers 301 are guided along the axial direction of the guiding unit 206 without adhering to the inner wall of the guiding unit 206.

Next, the nanofibers 301 transported to the diffusing unit 240 reduces its traveling speed gradually, and at the same time, are evenly dispersed (diffusing process). Here, the diffusing unit 240 has a shape that the opening has a smooth and closed shape at any cross section; and thus, the gas flow evenly disperses as a whole, and the velocity evenly decreases. At this time, it is a state where an eddying flow is unlikely to occur locally. Therefore, the nanofibers 301 transported by the gas flow are also dispersed evenly in accordance with the gas flow. In particular, since the three-dimensional shape of the inside of the diffusing unit 240 is a convex shape, it is considered that the above effect is notably seen.

In such a state, the attracting electrode 112 placed at the opening portion of the diffusing unit 240 attracts the nanofibers 301 because the attracting electrode 112 is charged to a polarity opposite to the charge polarity of the nanofibers 301. Further, the nanofibers 301 are also attracted onto the deposition member 101 by the drawing unit 102. In such a manner, the nanofibers 301 are deposited on the deposition member 101 (collecting process).

Accordingly, the evaporation of the solvent included in the solution 300 occurs inside the guiding unit 206; however, the gas flow is present inside the guiding unit 206 and always flows until it is drawn and collected by the drawing unit 102. Therefore, vapor of the solvent does not stay inside the guiding unit 206. Therefore, the inside of the guiding unit 206 does not exceed the explosion limit. As a result, it is possible to manufacture the nanofibers 301 while keeping a safe condition.

Further, a flammable solvent can be used. This expands the kinds of organic solvents that can be used as a solvent, and allows selection of an organic solvent that has less negative effect on human health. In addition, manufacturing efficiency of the nanofibers 301 can be improved by selecting an organic solvent having high evaporation efficiency as a solvent.

Further, the nanofibers 301 are deposited evenly on the deposition member 101 because the nanofibers 301 are attracted to the attracting electrode 112 after being evenly diffused and dispersed by the diffusing unit 240. Accordingly, in the case where the deposited nanofibers 301 are used as a nonwoven fabric, it is possible to obtain a nonwoven fabric having a stable performance across the entire surface. Further, in the case where the deposited nanofibers 301 are spun, yarn with stable performance can be obtained.

Here, examples of resin constituting the nanofibers 301 include polypropylene, polyethylene, polystyrene, polyethylene oxide, polyethylene terephthalate, polybutylene terephthalate, polyethylene naphthalate, poly-m-phenylene terephthalate, poly-p-phenylene isophthalate, polyvinylidene fluoride, polyvinylidene fluoride-hexafluoropropylene copolymer, polyvinyl chloride, polyvinylidene chloride-acrylate copolymer, polyacrylonitrile, polyacrylonitrile-methacrylate copolymer, polycarbonate, polyarylate, polyester carbonate, nylon, aramid, polycaprolactone, polylactic acid, polyglycolic acid, collagen, polyhydroxybutyric acid, polyvinyl acetate, polypeptide and copolymer of these. Further, one type selected from the above may be used, or various types may be mixed. Note that these are just examples, and the present invention should not be limited to the above resins.

Examples of the solvents used for the solution 300 include methanol, ethanol, 1-propanol, 2-propanol, hexafluoroisopropanol, tetraethylene glycol, triethylene glycol, dibenzyl alcohol, 1,3-dioxolane, 1,4-dioxane, methyl ethyl ketone, methyl isobutyl ketone, methyl-n-hexyl ketone, methyl-n-propyl ketone, diisopropyl ketone, diisobutyl ketone, acetone, hexafluoroacetone, phenol, formic acid, methyl formate, ethyl formate, propyl formate, methyl benzoate, ethyl benzoate, propyl benzoate, methyl acetate, ethyl acetate, propyl acetate, dimethyl phthalate, diethyl phthalate, dipropyl phthalate, methyl chloride, ethyl chloride, methylene chloride, chloroform, o-chlorotoluene, p-chlorotoluene, chloroform, carbon tetrachloride, 1,1-dichloroethane, 1,2-dichloroethane, trichloroethane, dichloropropane, dibromoethane, dibromopropane, methyl bromide, ethyl bromide, propyl bromide, acetic acid, benzene, toluene, hexane, cyclohexane, cyclohexanone, cyclopentane, o-xylene, p-xylene, m-xylene, acetonitrile, tetrahydrofuran, N,N-dimethylformamide, N,N-dimethylacetamide, dimethyl sulfoxide, pyridine, and water. Further, one type selected from the above may be used, or various types may be mixed. Note that these are just examples, and the present invention should not be limited to the above solvents. More specifically, the composition ratio is set such that a predetermined viscosity is obtained by selecting an appropriate solvent depending on the resin.

In addition, some additive agent such as aggregate or plasticizing agent may be added to the solution 300. Examples of additive agent include oxides, carbides, nitrides, borides, silicides, fluorides, and sulfides. However, in view of thermal resistance, workability, and the like, oxides are preferable. Examples of oxides include $Al_2O_3$, $SiO_2$, $TiO_2$, $Li_2O$, $Na_2O$, MgO, CaO, SrO, BaO, $B_2O_3$, $P_2O_5$, $SnO_2$, $ZrO_2$, $K_2O$, $Cs_2O$, ZnO, $Sb_2O_3$, $As_2O_3$, $CeO_2$, $V_2O_5$, $Cr_2O_3$, MnO, $Fe_2O_3$, CoO, NiO, $Y_2O_3$, $Lu_2O_3$, $Yb_2O_3$, $HfO_2$, and $Nb_2O_5$. Further, one type selected from the above may be used, or various types may be mixed. Note that these are just examples, and the present invention should not be limited to the above additive agents.

Desirable mixing ratio of solvent and resin depends on the kinds of the solvent and the resin, but preferable amount of the solvent is in the range of approximately not less than 60 wt % and not more than 98 wt %.

As described, even if the solution 300 includes the solvent of 50 wt % or more as above, the solvent evaporates sufficiently because solvent vapor does not stay due to the gas flow. This allows electrostatic stretching phenomenon to occur. Since the nanofibers 301 are manufactured from the state where the resin that is solute is thin, thinner nanofibers 301 can also be manufactured Further, the adjustable range of the solution 300 increases, allowing wider range of performances of the manufactured nanofibers 301.

Figure 18:
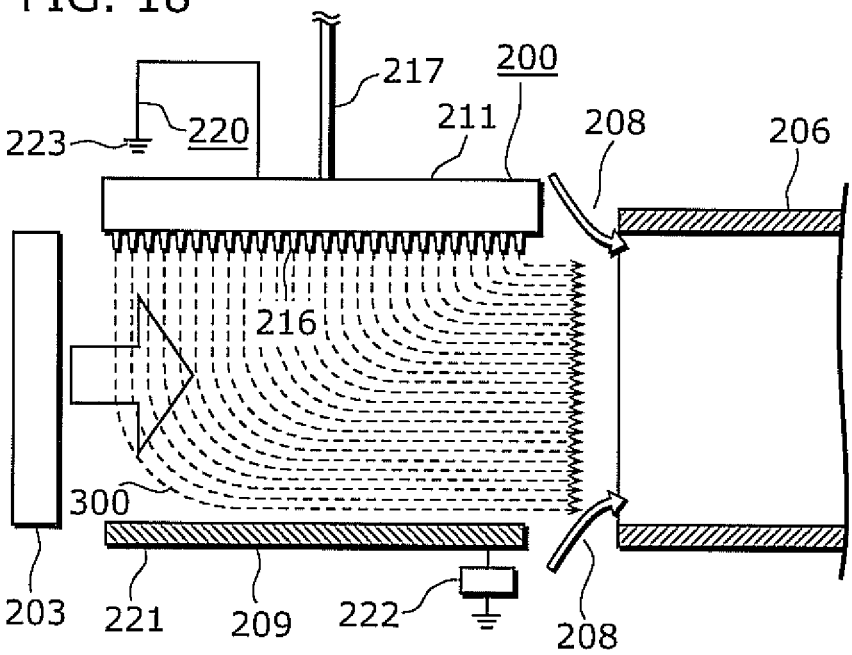
FIG. 18 is a cross section diagram schematically showing a discharging apparatus.

Note that in the present embodiment, the solution 300 is effused by the centrifugal force; however, the present invention is not limited to this. For example, the discharge apparatus 200 as shown in FIG. 18 may be used. In particular, the discharging apparatus 200 includes an effusing body 211 having a plurality of effusion holes 216 on a wall surface of the air channel 209 having a rectangular cross section. The charging electrode 221 is provided so as to face the wall surface, on which the effusion holes are provided, of the air channel 209. An electric field is generated by generating a potential difference between the effusion holes 216 and the charging electrode 221 to charge the solution. In such a manner, the extruding body 211 and the charging electrode 221 serve as the charging unit 202. Further, at one end of the opening of the air channel 209, the gas flow generating unit 203 is provided. Further, it may be that the guiding unit 206 having a cross section shape (rectangular) same as that of the air channel 209 may be provided with a predetermined distance from the discharging apparatus 200. In this case, the spacing between the discharging apparatus 200 and the guiding unit 206 serves as the inlet 208.

Figure 19:
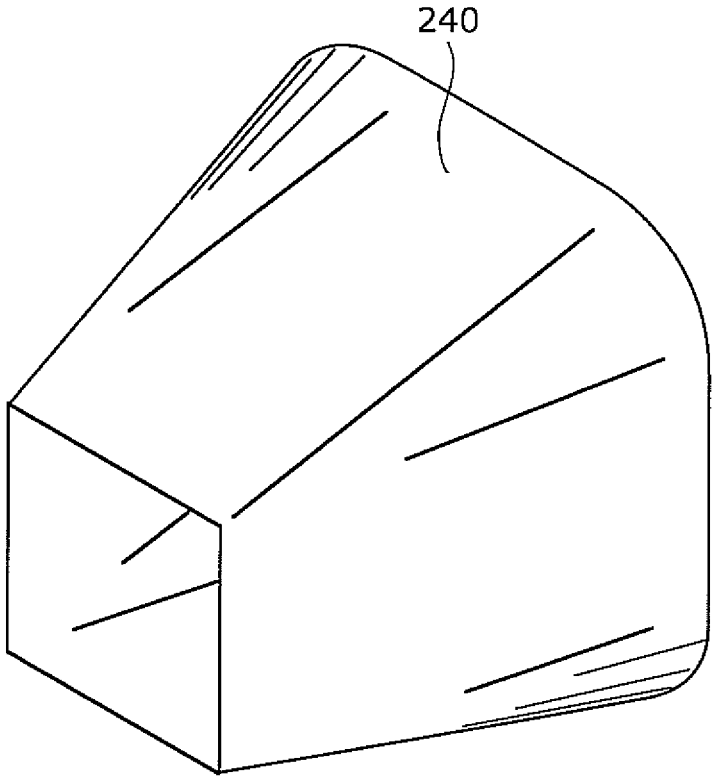
FIG. 19 is a perspective diagram schematically showing a diffusing unit according to another embodiment.

In this case, it may be that as shown in FIG. 19, the diffusing unit 240 has a shape which gradually changes from the opening at the upstream end corresponding to the shape of the guiding unit 206 and whose cross-section area gradually increases.

Further, the guiding unit 206 can be omitted where necessary. In this case, the discharging apparatus 200 is directly connected to the diffusing unit 240.

Further, the attracting electrode 112 is connected to the attraction power source 113; however, the same advantageous effects can be obtained even by grounding the attracting electrode 112 and attracting the charged nanofibers.

[Variation]

Next, an example according to the present invention is described.

The nanofiber manufacturing apparatus 100 as shown in FIG. 12 was used for manufacturing nonwoven fabric made of nanofibers and the obtained nonwoven fabric was evaluated.

The manufacturing conditions were as follows.

1) Effusing body: diameter of ϕ60 mm.

2) Effusion holes: 108 effusion holes, hole diameter of 0.3 mm.

3) Effusing conditions: the number of rotations is 2000 rpm.

4) Materials of the nanofibers: PVA (polyvinyl alcohol).

5) Solution: solvent is water, mix ratio with the PVA is solvent of 90 wt %.

6) Charging electrode: inside diameter of ϕ 600 mm.

Charging power source is negative 60 KV.

7) Guiding unit: inside diameter of ϕ 600 mm, cross section opening shape is circular, length is 1000 mm.

8) Deposition member: Width of 400 mm, traveling speed of 1 mm/minute.

Attraction power source is negative 30 KV.

9) flow rate inside the guiding unit: 30 m3/minute.

10) Diffusing unit: inclination of ⅓.

11) Diffusing unit as an comparative example: inclination of 1/1.

The thickness of the nonwoven fabric obtained under the above conditions was measured in the width direction.

The following shows the results.

Inclination was ⅓: maximum thickness was 36 μm, minimum thickness was 30 μm, and the average thickness was 33 μm.

Figure 20:
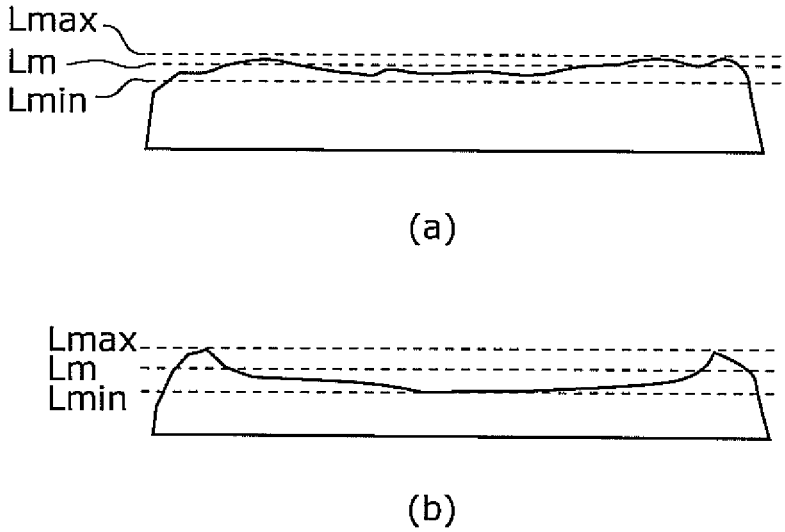
FIG. 20 is a cross-section diagram schematically showing deposited nanofibers.

Its shape was as shown in FIG. 20 (*a*).

Inclination was 1/1, maximum thickness was 45 μm, minimum thickness was 20 μm, and the average thickness was 30 μm.

Its shape was as shown in FIG. 20 (*b*).

The results have shown that the nanofiber manufacturing apparatus according to an aspect of the present invention can deposit the nanofibers evenly.

INDUSTRIAL APPLICABILITY

The present invention can be applied to the manufacturing of the nanofibers by the electrostatic stretching phenomenon (electrospinning method), and to the manufacturing of nonwoven fabric or the like on which the nanofibers are deposited.

The invention claimed is:

1. A nanofiber manufacturing apparatus comprising:

an effusing unit configured to effuse a solution which is a raw material liquid for nanofibers into a space;

a first charging unit configured to electrically charge the solution by applying an electric charge to the solution;

a guiding unit which forms an air channel for guiding the nanofibers that are manufactured;

a gas flow generating unit configured to generate, inside said guiding unit, gas flow for transporting the nanofibers;

a collecting apparatus which collects the nanofibers; and an attracting apparatus which attracts the nanofibers to said collecting apparatus;

wherein said collecting apparatus includes a deposition member which is in an elongated band shape and on which the nanofibers are deposited, a supplying unit configured to supply the deposition member, a transporting unit configured to collect the deposition member, and a body which is movable with said deposition member, said supplying unit, and said transporting unit mounted on said body.

2. The nanofiber manufacturing apparatus according to claim 1, wherein said collecting apparatus is constituted by a first collecting apparatus, which is one of a plurality of collecting apparatuses, said first collecting apparatus is mounted with an electric field attracting apparatus which attracts the nanofibers using an electric field, said plurality of collecting apparatuses further includes a second collecting apparatus, said deposition member is included in the second collecting apparatus, and includes an air hole for ensuring air permeability, and said second collecting apparatus is further mounted with a gas attracting apparatus which attracts the nanofibers using the gas flow.

3. A nanofiber manufacturing apparatus comprising:

an effusing unit configured to effuse a solution which is a raw material liquid for nanofibers into a space;

a first charging unit configured to electrically charge the solution by applying an electric charge to the solution;

a guiding unit which forms an air channel for guiding the nanofibers that are manufactured;

a gas flow generating unit configured to generate, inside said guiding unit, gas flow for transporting the nanofibers;

a collecting apparatus which collects the nanofibers;

an attracting apparatus which attracts the nanofibers to said collecting apparatus; and a diffusing unit which is an air channel for diffusing and guiding the nanofibers with the gas flow, said diffusing unit having a shape in which an opening area having a cross section perpendicular to a transporting direction of the nanofibers continuously increases in the transporting direction of the nanofibers.

4. A nanofiber manufacturing method comprising:

effusing a solution which is a raw material liquid for nanofibers into a space;

electrically charging the solution by applying an electric charge to the solution;

generating gas flow and transporting the nanofibers by the generated gas flow;

collecting the nanofibers; and attracting the nanofibers to a predetermined area compressing the space where the nanofibers transported by the gas flow are present so as to increase a density of the nanofibers in the space; and transporting the nanofibers while diffusing the nanofibers with the gas flow at a predetermined diffusion ratio.

* * * * *